US008327570B2

(12) United States Patent
Potterfield et al.

(10) Patent No.: US 8,327,570 B2
(45) Date of Patent: Dec. 11, 2012

(54) ADJUSTABLE FIREARM SUPPORTS AND ASSOCIATED METHODS OF USE AND MANUFACTURE

(75) Inventors: Russell A. Potterfield, Columbia, MO (US); Tim Kinney, Columbia, MO (US); Dennis Cauley, Boonville, MO (US); Yan-Jiang Zhou, Columbia, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 13/095,549

(22) Filed: Apr. 27, 2011

(65) Prior Publication Data

US 2012/0085012 A1 Apr. 12, 2012

Related U.S. Application Data

(63) Continuation of application No. 12/117,668, filed on May 8, 2008, now Pat. No. 7,954,272.

(60) Provisional application No. 60/916,725, filed on May 8, 2007, provisional application No. 60/971,507, filed on Sep. 11, 2007.

(51) Int. Cl.
*F41C 27/00* (2006.01)

(52) U.S. Cl. ..... 42/94; 89/37.04; 73/167; 248/125.8; 248/125.9

(58) Field of Classification Search ..... 42/94; 89/37.04; 73/167; 248/125.8, 125.9
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,187,325 | A | 6/1916 | Ivey |
| 1,295,688 | A | 2/1919 | Butler |
| 1,491,604 | A | 4/1924 | Fuller |
| 1,639,722 | A | 8/1927 | Whitney |
| 2,079,510 | A | 5/1937 | King et al. |
| 2,774,090 | A | 12/1956 | Allinson |

(Continued)

OTHER PUBLICATIONS

U.S. Appl. No. 12/209,113, Potterfield et al.

(Continued)

*Primary Examiner* — Michael Carone
*Assistant Examiner* — Samir Abdosh
(74) *Attorney, Agent, or Firm* — Perkins Coie LLP

(57) ABSTRACT

Adjustable firearm supports, and more specifically adjustable bipods, are disclosed herein. In one embodiment, a firearm support includes a stock mount assembly configured to support a forestock of the firearm and an attachment assembly carried by the stock mount assembly. The attachment assembly is configured to releasably attach to the forestock of the firearm. The firearm support also includes first and second legs operably coupled to the support plate. Each leg is pivotable between a stowed position and an extended position. In the stowed position the legs are generally parallel to a longitudinal axis of the firearm, and in the extended position the legs are generally transverse to the longitudinal axis of the firearm.

17 Claims, 14 Drawing Sheets

U.S. PATENT DOCUMENTS

| | | | | |
|---|---|---|---|---|
| 2,817,233 | A | 12/1957 | Dower et al. | |
| 2,847,909 | A | 8/1958 | Kester | |
| 2,874,707 | A | 2/1959 | Koppel | |
| 3,013,289 | A | 12/1961 | Sasena | |
| 3,024,653 | A | 3/1962 | Broadway | |
| 3,107,642 | A | 10/1963 | Lakin | |
| 3,125,929 | A | 3/1964 | Peasley | |
| 3,137,957 | A | 6/1964 | Ingalls | |
| 3,205,518 | A | 9/1965 | Romaine | |
| 3,225,656 | A | 12/1965 | Flaherty et al. | |
| D203,680 | S | 2/1966 | Benchrest | |
| 3,283,643 | A | 11/1966 | Mittelsteadt | |
| 3,327,422 | A * | 6/1967 | Harris | 42/94 |
| D215,311 | S | 9/1969 | Born | |
| 3,536,160 | A | 10/1970 | Brewer | |
| D220,154 | S | 3/1971 | Irelan | |
| 3,646,704 | A | 3/1972 | Ellsworth | |
| 3,680,354 | A | 8/1972 | Phillips, Jr. | |
| 3,711,984 | A | 1/1973 | Dyer et al. | |
| 3,736,243 | A | 5/1973 | Duggan | |
| 3,738,101 | A | 6/1973 | Simon-Vermot | |
| 3,743,088 | A | 7/1973 | Henkin | |
| 3,771,176 | A | 11/1973 | Herman, Sr. | |
| 3,804,238 | A | 4/1974 | Howard | |
| D233,853 | S | 12/1974 | Ferrara | |
| 3,877,178 | A | 4/1975 | Campanelli | |
| 3,878,939 | A | 4/1975 | Wilcox | |
| 3,899,797 | A | 8/1975 | Gunst | |
| D237,106 | S | 10/1975 | Baljet et al. | |
| 3,935,657 | A | 2/1976 | Wade | |
| 3,949,987 | A | 4/1976 | Candor | |
| 4,090,606 | A | 5/1978 | Dawson | |
| D257,687 | S | 12/1980 | Bechtel | |
| 4,266,780 | A | 5/1981 | McQuary | |
| D260,650 | S | 9/1981 | Alviti | |
| D261,794 | S | 11/1981 | Bechtel | |
| 4,345,398 | A * | 8/1982 | Pickett | 42/94 |
| 4,361,989 | A | 12/1982 | Ohno | |
| 4,480,411 | A | 11/1984 | Balz et al. | |
| D283,561 | S | 4/1986 | Geist | |
| 4,625,620 | A * | 12/1986 | Harris | 89/37.04 |
| 4,715,499 | A | 12/1987 | Franklin | |
| 4,716,673 | A | 1/1988 | Williams et al. | |
| 4,721,205 | A | 1/1988 | Burt et al. | |
| 4,736,843 | A | 4/1988 | Leonard | |
| D297,855 | S | 9/1988 | Ruger et al. | |
| 4,790,096 | A | 12/1988 | Gibson et al. | |
| 4,821,443 | A | 4/1989 | Bianco | |
| 4,824,086 | A | 4/1989 | Rickling et al. | |
| D304,223 | S | 10/1989 | Ruger et al. | |
| 4,890,406 | A | 1/1990 | French | |
| D306,234 | S | 2/1990 | Ferstl | |
| 4,910,904 | A | 3/1990 | Rose | |
| D310,302 | S | 9/1990 | Southard | |
| D313,886 | S | 1/1991 | Southard | |
| 5,074,188 | A * | 12/1991 | Harris | 89/37.04 |
| 5,143,340 | A | 9/1992 | Wood et al. | |
| 5,173,563 | A | 12/1992 | Gray | |
| 5,194,678 | A | 3/1993 | Kramer | |
| D335,896 | S | 5/1993 | Evenson | |
| 5,211,404 | A | 5/1993 | Grant | |
| 5,233,779 | A | 8/1993 | Shaw | |
| 5,237,778 | A | 8/1993 | Baer | |
| 5,287,643 | A | 2/1994 | Arizpe-Gilmore | |
| 5,320,223 | A | 6/1994 | Allen | |
| 5,333,829 | A | 8/1994 | Bell et al. | |
| 5,337,505 | A | 8/1994 | Brown et al. | |
| 5,347,740 | A | 9/1994 | Rather et al. | |
| 5,351,428 | A | 10/1994 | Graham | |
| 5,394,983 | A | 3/1995 | Latulippe et al. | |
| 5,410,833 | A | 5/1995 | Paterson | |
| D359,392 | S | 6/1995 | Bellington | |
| D362,116 | S | 9/1995 | Bellington et al. | |
| 5,446,987 | A | 9/1995 | Lee et al. | |
| D364,080 | S | 11/1995 | Weyrauch | |
| 5,490,302 | A | 2/1996 | Dion | |
| D369,904 | S | 5/1996 | Taylor | |
| 5,540,329 | A | 7/1996 | Vogeley | |
| D375,538 | S | 11/1996 | Minneman | |
| 5,588,242 | A | 12/1996 | Hughes | |
| 5,622,344 | A * | 4/1997 | Gracie | 248/171 |
| D380,116 | S | 6/1997 | Minneman | |
| 5,651,207 | A | 7/1997 | Knight | |
| D387,123 | S | 12/1997 | Hughes et al. | |
| 5,703,317 | A * | 12/1997 | Levilly et al. | 89/37.03 |
| 5,711,103 | A | 1/1998 | Keng | |
| 5,715,625 | A | 2/1998 | West, III | |
| D391,616 | S | 3/1998 | Plybon | |
| 5,758,933 | A | 6/1998 | Clendening | |
| 5,815,974 | A | 10/1998 | Keng | |
| D403,176 | S | 12/1998 | Harper | |
| 6,042,080 | A | 3/2000 | Shepherd et al. | |
| 6,092,662 | A | 7/2000 | Frederick, Jr. | |
| 6,237,462 | B1 | 5/2001 | Hawkes et al. | |
| 6,269,578 | B1 | 8/2001 | Callegari | |
| 6,289,622 | B1 * | 9/2001 | Desch et al. | 42/94 |
| 6,397,720 | B1 | 6/2002 | Fox et al. | |
| 6,439,530 | B1 | 8/2002 | Schoenfish et al. | |
| 6,517,133 | B2 | 2/2003 | Seegmiller et al. | |
| D471,248 | S | 3/2003 | Jacobs | |
| D473,376 | S | 4/2003 | Abate | |
| 6,733,375 | B2 | 5/2004 | Hoffman | |
| 6,860,054 | B1 | 3/2005 | Mosher | |
| 6,871,440 | B2 | 3/2005 | Highfill et al. | |
| 6,931,777 | B1 | 8/2005 | Krien | |
| D513,055 | S | 12/2005 | Lahti | |
| D519,183 | S | 4/2006 | Minneman | |
| 7,032,494 | B2 * | 4/2006 | Wygant | 89/37.04 |
| D521,100 | S | 5/2006 | Morrow | |
| D524,541 | S | 7/2006 | Cauley | |
| 7,104,398 | B1 | 9/2006 | Wisecarver | |
| 7,143,986 | B1 * | 12/2006 | Austin et al. | 248/187.1 |
| 7,159,711 | B1 | 1/2007 | Gardner | |
| 7,165,750 | B2 | 1/2007 | McCuskey et al. | |
| 7,188,445 | B2 | 3/2007 | Lehman | |
| D540,904 | S | 4/2007 | Werner | |
| D543,604 | S | 5/2007 | Minneman | |
| 7,213,494 | B2 | 5/2007 | James | |
| D553,219 | S | 10/2007 | Potterfield | |
| 7,281,346 | B1 | 10/2007 | Cook et al. | |
| D567,895 | S | 4/2008 | Cauley | |
| 7,356,960 | B1 | 4/2008 | Knitt | |
| 7,356,961 | B2 | 4/2008 | Williams | |
| 7,367,451 | B2 | 5/2008 | Pendergraph et al. | |
| 7,401,431 | B2 * | 7/2008 | Pierce et al. | 42/94 |
| 7,410,053 | B2 | 8/2008 | Bowen et al. | |
| D576,245 | S | 9/2008 | Potterfield et al. | |
| 7,421,815 | B1 | 9/2008 | Moody et al. | |
| 7,426,800 | B2 * | 9/2008 | Pierce et al. | 42/94 |
| 7,536,820 | B2 | 5/2009 | Wade et al. | |
| 7,549,247 | B1 | 6/2009 | Reese | |
| 7,584,690 | B2 | 9/2009 | Cauley | |
| D605,246 | S | 12/2009 | Hobbs | |
| 7,631,455 | B2 | 12/2009 | Keng et al. | |
| 7,676,977 | B1 | 3/2010 | Cahill et al. | |
| 7,726,478 | B2 | 6/2010 | Potterfield et al. | |
| 7,730,824 | B1 | 6/2010 | Black | |
| 7,954,272 | B2 * | 6/2011 | Potterfield et al. | 42/94 |
| 2002/0195752 | A1 | 12/2002 | Yang | |
| 2003/0079395 | A1 | 5/2003 | Chong | |
| 2004/0020097 | A1 | 2/2004 | Deros | |
| 2004/0112777 | A1 | 6/2004 | Huang | |
| 2005/0178039 | A1 | 8/2005 | Flores | |
| 2005/0183319 | A1 * | 8/2005 | Franks | 42/94 |
| 2005/0188597 | A1 * | 9/2005 | Keng et al. | 42/94 |
| 2005/0242250 | A1 | 11/2005 | Keng et al. | |
| 2006/0063653 | A1 | 3/2006 | Wickens et al. | |
| 2006/0236584 | A1 | 10/2006 | Williams | |
| 2006/0248774 | A1 * | 11/2006 | Pierce et al. | 42/94 |
| 2006/0277811 | A1 | 12/2006 | Peterson | |
| 2006/0278797 | A1 * | 12/2006 | Keng et al. | 248/440.1 |
| 2007/0051028 | A1 | 3/2007 | Stordal | |
| 2007/0068379 | A1 | 3/2007 | Sween et al. | |
| 2007/0068835 | A1 | 3/2007 | Buie | |
| 2007/0094911 | A1 * | 5/2007 | Rush et al. | 42/85 |
| 2007/0294930 | A1 | 12/2007 | Mays | |
| 2008/0047189 | A1 * | 2/2008 | Potterfield et al. | 42/94 |

| | | | | |
|---|---|---|---|---|
| 2008/0128002 | A1 | 6/2008 | Jeffs | |
| 2008/0156671 | A1 | 7/2008 | Jansson | |
| 2008/0163534 | A1 | 7/2008 | Lombardi | |
| 2008/0295379 | A1* | 12/2008 | Potterfield et al. | 42/94 |
| 2009/0049731 | A1* | 2/2009 | Seuk | 42/94 |
| 2009/0056192 | A1* | 3/2009 | Oz | 42/94 |
| 2009/0064559 | A1* | 3/2009 | Potterfield et al. | 42/94 |
| 2009/0126250 | A1* | 5/2009 | Keng | 42/94 |
| 2010/0102178 | A1* | 4/2010 | Smith et al. | 248/122.1 |
| 2010/0116163 | A1 | 5/2010 | Zara | |
| 2011/0036236 | A1 | 2/2011 | Potterfield et al. | |

OTHER PUBLICATIONS

U.S. Appl. No. 12/276,223, Potterfield et al.
U.S. Appl. No. 12/276,229, Cauley et al.
U.S. Appl. No. 12/476,041, Cauley.
U.S. Appl. No. 12/578,393, Morrow et al.
U.S. Appl. No. 12/623,238, Potterfield.
U.S. Appl. No. 12/769,438, Potterfield.
U.S. Appl. No. 12/846,543, Potterfield.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
"Cleaning Cradles: Sinclaire Cleaning Cradles" p. 21, The date on which the Sinclair Folding Cleaning Cradle was first on sale is not known, but is believed to be circa 2004.
"Decker Rifle Vise," 1 page. The date on which the Decker Rifle Vise was first on sale is not known but is believed to be circa 2004.
"Eforcity Magnetic Screwdriver Set w/15 bits Great for Cellphones, Computers Includes: T6, TORX, Security TORX, Philips, Slotted, Spanner, Tri-Wing, Bent Pry Tool, Round Awl, Reset Pin for Game Boy Advance, Nintendo Wii, DS lite, NDS, Apple TV", Amazon.com , accessed on Sep. 18, 2007.
"Gun Rest—Shooting Rest—Rifle Rests," http://www.jexploreproducts.com/gunrests-shootingrests.htm, 6 pages [Internet accessed Jul. 18, 2008].
"Plano Shooters Case, Brown Camo," The Sportsman's Guide, http://www.sportmansguide.com/cb/cb.asp?a=148225, the date on which the Plano Shooters Case was first on sale is not known but is believed to be circa 2004, 3 pages [Internet accessed No. Oct. 11, 2006].
"Reloading Manual No. Ten for Rifle and Pistol," The Cartridge Components, SPEER Omark Industries, pp. 28-54.
"Shotshell reloading with a Grabber," MEC—Mayville Engineering Company, Inc., pp. 1-12.
"The Grabber and Hustler '76," MEC—Mayville Engineering Company, Inc., 2 pgs, date unknown.
"Uncle Bud'S Bull Bags," http:www.unclebudscss.com/pages/Bulls% 20bags.html, 2 pgs. [Internet accessed on Feb. 14, 2006].
"Uncle Bud'S Udder Bag," http:www.unclebudscss.com/pages/Udder%20Bags.html, 2 pgs. [Internet accessed on Feb. 14, 2006].
1shop2.com "Hoppe's Gunsmith's Fully Adjustable Bench Vise" 3 pages. The date on which The Hoppe's Gunsmith's Fully Adjustable Bench Vise was first on sale is not known, but is believed to be circa 2004.
AcuSport, Outdoor Sporting Products, 3 pgs., undated.
Amazon.com, "CTK® P3 Ultimate Shooting Rest," Sports & Outdoors, http://www.amazon.com/CTK%C2%AE-P3-Ultimate-Shooting-Rest/dp/ . . . , 1 page [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . ., 1 page [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].
Auto-Flo Lyman Turbo 1200 Tumbler, 2 pages [product photos].
Basspro.com, "Bass Pro Shops Outdoors Online: Offering the best in Fishing, Hunting and Outdoor Products," http://www.basspro.com/webapp/wcs/stores/servlet/Product__10151__-1__10001__95064 SearchResults, 2 pages [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," 1 page [Internet accessed Jan. 25, 2006].
Big Boy Gun Toys, "Shooting Rest," http://www.bigboyguntoys.com/shootingrest.htm, 1 page [Internet accessed on Jul. 18, 2008].
Birchwood Casey 2005 Catalog, 28 pages.
Birchwood Casey 2006 Catalog. The date of availability of this catalog is unknown, but is believed to be in Jan. 2006 or later. pp. 5-17.
Birchwood Casey, "Dirty Bird@Splattering Targets," http://www.birchwoodcasey.com/sport/target_index.asp?categoryID=4 &subcat=22 , pp. 1-4 internet accessed Jan. 16, 2006.
Birchwood Casey, "Shoot•N•C® Targets," http://www.birchwoodcasey.com/sport/target_index.asp?categoryID=4 &subcat=8, pp. 1-8, internet accessed Jan. 16, 2006.
Birchwood Casey, "Targets Spots®." http://www.birchwoodcasey.com/sport_index.asp?categoryID=4&subcat=12 , pp. 1-2, internet accessed Jan. 16, 2006.
Birchwood Casey, "World of Targets®" http://www.birchwoodcasey.com/sport/target_index.asp?categoryID=4 &subcat=13 , pp. 1-4, internet accessed Jan. 16, 2006.
Boyt Harness Company, Product Catalog, http://www.boytharness.com/catalog/index.php?cPath=22, 2 pages [Internet accessed on Jul. 21, 2008].
Brownells Inc., Brownells Magna-Tip Screwdriver, Brownells Catalog No. 54 for 2001-2002, 2001, p. 151.
Brownells Inc., Brownells Magna-Tip Super-Sets, Brownells Catalog No. 54 for 2001-2002, 2001, p. 153.
Brownells Inc., Catalog No. 41 1988-1989 3 pages (8909).
Brownells Inc., Catalog No. 47 1994-1995 2 pages (8909).
Brownells Inc., Catalog No. 57. For 2004-2005. 2 pages.
Brownells Inc., Sight Base Cutters, Faxed Dec. 17, 2003, 1 page.
B-Square , Pro Gunsmith Screwdriver Set, B-Square Mounts Tools Accessories Product Catalog, p. 23, date unknown.
Cabela's "Master Catalog Fall 2003: Late-Season Edition" Cover page and p. 416. 2 pages.
Cabela's Hunting Fishing and Outdoor Gear Master Catalog, Fall 2002, Edition II, Minimizer Rifle Rest, Item No. SC-22-4332, p. 492.
Cabela's, "BenchBuddy® Gun Rest," http://www.cabelas.com/cabelas/en/templates/links/link.jsp?id=0005819221954a &type=product&cmCat=, © 1996-2008, 2 pages [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pages [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pages [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pages [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pages [Internet accessed on Aug. 6, 2008].
Cabela's, "Premier Rifle Rest," http://www.cabelas.com/cabelas/en/templates/links/link.jsp?id=0020904227856a&type=product &cmCat=.., © 1996-2008, 2 pages [Internet accessed on Aug. 6, 2008].

Cabela's, "Secure Bench Rest," http://www.cabelas.com/cabelas/en/templates/links/link.jsp;jsessionid=4F0LP0OW2HMRLLAQBBISCOF.., © 1996-2008, 2 pages [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].
Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].
Cabela's, "Shooting Benches & Portable Rifle Shooting Bench Rest," http://www.cabelas.com/ssubcat-1/cat20793.shtml, 3 pages [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pages [Internet accessed on Jul. 15, 2008].
Cabela's, "HySkore Sighting System and Cleaning Vise," the date on which the HySkore Sighting System and Cleaning Vise was first on sale is not known, but is believed to be circa Jan. 2005. However, a prototype of this product may have been shown to buyers at Cabela's circa Aug. 2004, 1 page.
Caldwell Insta-View™ 4" Targets.
Caldwell Shooting Supplies, 2006 Catalog, pp. 18, 5, 12, 14 and 15.
Caldwell Shooting Supplies, Targets & Target Accessories, Instra-View™ Targets, 1 page.
Caldwells Insta-View 4" Targets, 1 page [product photo].
Californiavarmintcallers.com—Forum, http://californiavarmintcallers.com/community/modules/newbb/viewtopic.php?topic_id=10&forum=9&PHPSESSID=074ed8c7 . . . , pp. 1-4, accessed Jan. 16, 2006.
Canadian Camo, "Gun Rest," http://media5.magma.ca/www.canadiancamo.com/catalog/product_info.php?products_id= . . . , 2 pages [Internet accessed on Feb. 13, 2006].
Carmichael, J., "Reloading for Accuracy," Lyman Reloading Handbook, 46th Edition, pp. 68-77.
Champion Targets, "Next Generation Paper Targets," http://www.championtarget.com/products/targets/next_generation_targets.aspx , pp. 1-3, [internet accessed Jan. 16, 2006].
Champion Traps & Target, 2005 Product Catalog , 12 pages.
Chastain, R., "Load 'em Up!" About.com: Hunting/Shooting, http://hunting.about.com/od/reloadinginfo/a/aaloademup_2htm , 6 pages [Internet accessed on Aug. 31, 2007].
Cork Industries, Inc., "Double Bumping Coating Applications," Cork Tech TalkNews, Feb. 1997, 2 pages.
CTK Precision, "P3 Ultimate Shooting Rest," http://www.ctkprecision.com/index.asp?PageAction=VIEWPROD&ProdOID=2, 3 pages [Internet accessed on Jul. 18, 2008].
CTK Precision, All Products, http://www.ctkprecision.com/index.asp?PageAction=VIEWCATS&Cate.., 3 pages [Internet accessed on Jul. 22, 2008].
CV-500, 3 pages [product photos].
Device manufactured by Shooter's Ridge, a division of ATK, and available at least by late 2005, 1 page.
Dillon Precision CV-500 Cartridge Case Vibratory Cleaner, 6 pages [product photos].
E. Arthur Brown Company, "A Shooting Rest that Really Works..," http://www.eabco.com/TargetShooting01.html, © 2007-2008, 1 page [Internet accessed Jul. 18, 2008].
Edgewood Shooting Bags Catalog, http://www.edgebag.com/catalog.php, 7 pages [Internet accessed on Feb. 14, 2006].
Ellett Brothers, Rests & Gun Vises, pp. 621-622, date unknown.
Grafix Plastics, http://grafixplastic.com/plastic_film_g.asp?gclid=CK-5-_7gnY4CFRVNhgodjFhfSQ , 29 pages [Internet accessed on Aug. 30, 2007].
Harris, J. et al., "The Art and Science of Annealing," http://www.6mmbr.com/annealing.html, © 2005, 13 pages [Internet accessed on Aug. 13, 2007].
Hyskore, "Rest—Dangerous Game Machine Rest," Hyskore Rest, Professional firearm rests, http://www.hyskore.com/rests.htm, 2 pages [Internet accessed Jul. 21, 2008].
Hyskore: Professional Shooting Accessories. "Dangerous Game Machine Rest," Accessed Feb. 22, 2006 www.hyskore.com, 10 pages.
Hyskore: Professional Shooting Accessories. "Hydraulic Trigger Release." Accessed Feb. 22, 2006. www.hyskore.com 7 pages.
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Lahti Company Brochure, "Rock Solid Hold," Rifle Evaluator, http://www.lathicompany.com/Forms/EvaluatorBrochure2.jpg, 2 pages. [Internet accessed Jan. 16, 2006].
Lahti Company Brochure, "Rifle Evaluator: No Pain, No Fear, No Flinching, No Body Movement," www.lahticompany.com, 2 pages, undated.
Lee Precision, Inc., "Load-All," 1 page.
Lee Precision, Inc., "The World's Fastest Handloading Press . . . Lee Progressive 1000," 1985 Catalog, pp. 1-15.
Lohman Sight Vise, 4 pages product photographs, the date on which the Lohman Site Vise was first on sale is not known, but is believed to be circa 2004.
Lyman Hornady Case Tumbler, 2 pages [product photos].
Lyman Turbo 600 Tumbler, 3 pages [product photos].
Lyman Turbo Pro 1200 Tumber, 2 pages [product photos].
Lyman, "A History of Lyman Metallic Reloading," Reloading Handbook, 46th Edition, pp. 10-31.
Lyman, "Introduction to Reloading," Reloading Handbook, 46th Edition, pp. 170-203.
MacksPW.com, "Desert Mountain Bench Master Rifle Rest," http://www.macksqw.com/Item--i-DESBM1, © 2004-2008, 1 page [Internet accessed Jul. 22, 2008].
Midway USA, Chapman 27-Piece Deluxe Screwdriver Set, Master Catalog and Reference Guide #2, 2004, p. 440.
Midway USA, Pachmayr Professional Screwdriver Set, Master Catalog and Reference Guide #2, 2004, p. 448.
Midway USA, Wheeler Engineering Space-Saver Gunsmithing Screwdriver Set, Master Catalog and Reference Guide #2, 2004, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MidwayUSA, "ADG Rifle Shooting Rest," http://www.midwayusa.com/eproductpage.exe/showproduct?saleitemid=992071&t=11082005, 2005, 3 pages [Internet accessed on Aug. 6, 2008].
MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].
MidwayUSA, "Caldwell Lead Sled DFT Rifle Shooting Rest," http://www.midwayusa.com/eproductpage.exe/showproduct?saleitemid=149023&t=11082005, 2005, 6 pages [Internet accessed on Aug. 6, 2008].
MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].
MidwayUSA, "Caldwell Steady Rest NXT Rifle Shooting Rest," http://www.midwayusa.com/eproductpage.exe/showproduct?saleitemid=838651&t=11082005, 2005, 4 pages [Internet accessed on Aug. 6, 2008].
MidwayUSA, "Caldwell Zero-Max Rifle Shooting Rest," http://www.midwayusa.com/eproductpage.exe/showproduct?saleitemid=726222&t=11082005, 2005, 3 pages [Internet accessed on Aug. 6, 2008].

MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].
MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].
MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].
MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].
MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pages [Internet accessed on Jul. 21, 2008].
MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].
Milek, B., "Handloading for Hunting" New Products from RCBS, Lee, Accurate Arms, Peterson's Hunting, Mar. 1985, p. 21.
Millett, "BenchMaster Shooting Rests," 1 page, Undated.
MTM Case-Gard, "Gun Maintenance Centers," http://www.mtmcase-gard.com/products/shooting/gunm.html, the date on which the MTM Gun Maintenance Center was first on sale is not known, but is believed to be circa 2004, 2 pages. [Internet accessed Oct. 11, 2006].
MTM Case-Gard, "MTM Shoulder-Gard Rifle Rest," Cover Photo for Rest, p. 2, date unknown.
MTM Case-Gard, "Rifle rest and pistol shoot rest," http://www/mtmcase-gard.com/products/shooting/shoo.html, the date on which the MTM Site-In-Clean was first on sale is not known, but is believed to be circa 2004, 3 pages. [Internet accessed on Oct. 11, 2006].
Precision Shooting, Inc., Bald Eagle Front Rest, The Accurate Rifle, vol. 6, Issue No. 4, May 2003, p. 47.
Protektor Model, "The Original Leather Rifle and Pistol Rest," http://www.protektormodel.com/, 12 pages [Internet accessed on Feb. 14, 2006].
RCBS Automatic Primer Tool, pp. 68-71, undated.
Shooters Ridge, "Deluxe Rifle Rest," http://www.shootersridge.com, 1 page [Internet accessed Jul. 21, 2008].
Shooters Ridge, "Shooting Rest with Gun Vise," http://www.shootersridge.com, 1 page [Internet accessed Jul. 17, 2008].
Sinclair International, Sinclair Shooting Rests, Products for the Precision Shooter, 2002, Issue No. 2002-B pp. 76-78.
Sweeney, P., "Gunsmithing: Measure Headspace," Peterson's Rifleshooter, http://www.rifleshootermag.com/gunsmithing/headspace_0612/ , 4 pages [Internet accessed Dec. 11, 2004].
Tenex Precision Co., "Recoil A-Rest-R," 4 pages, date unknown [product photos].

* cited by examiner

ADJUSTABLE FIREARM SUPPORTS AND ASSOCIATED METHODS OF USE AND MANUFACTURE

CROSS-REFERENCE TO RELATED APPLICATIONS

This application is a continuation of U.S. patent application Ser. No. 12/117,668, filed May 8, 2008, which claims the benefit of U.S. Provisional Patent Application No. 60/916,725, filed May 8, 2007, and U.S. Provisional Patent Application No. 60/971,507, filed Sep. 11, 2007, the disclosures of which are incorporated by reference herein in their entireties.

TECHNICAL FIELD

The present disclosure is directed to support assemblies for firearms. More specifically, several aspects of the disclosure are directed to adjustable bipod assemblies that removably attach to and support firearms.

BACKGROUND

Shooters often use firearm rests or supports to steady a firearm during target practice, accuracy testing, and hunting. Holding a firearm without a stable support may limit the shooter's ability to accurately fire the firearm. Many shooters accordingly use a support in an attempt to reduce or eliminate human movement inherent from holding the firearm. For example, shooters may place the forestock of a rifle on a front support and the buttstock of the rifle on a rear support. Alternatively, shooters may hold the buttstock and use a support only for the forestock of the rifle.

One type of support for the forestock of a rifle is a bipod support. Conventional bipod supports include attachment mechanisms that can be fixedly attached or removably attached to the forestock of the rifle. These bipods can also include legs that can be folded generally parallel to the barrel of the rifle for storage or to facilitate carrying the rifle. Examples of bipod supports are included in U.S. Pat. Nos. 3,327,422; 4,470,216; 4,625,620; 4,903,425; and 5,711,103. Examples of bipod supports are also available from the following companies: Harris Engineering, Inc., Barlow, Ky. 42024 (www.harrisbipods.com); and Keng's Firearms Specialty, Inc., 875 Wharton Drive, SW, Atlanta, Ga. 30336 (www.versapod.com).

BRIEF DESCRIPTION OF THE DRAWINGS

In the drawings, identical reference numbers identify similar elements. The sizes and relative position of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape or the particular elements, and have been solely selected for ease of recognition in the drawings.

DETAILED DESCRIPTION

A. Overview

Figure 1:
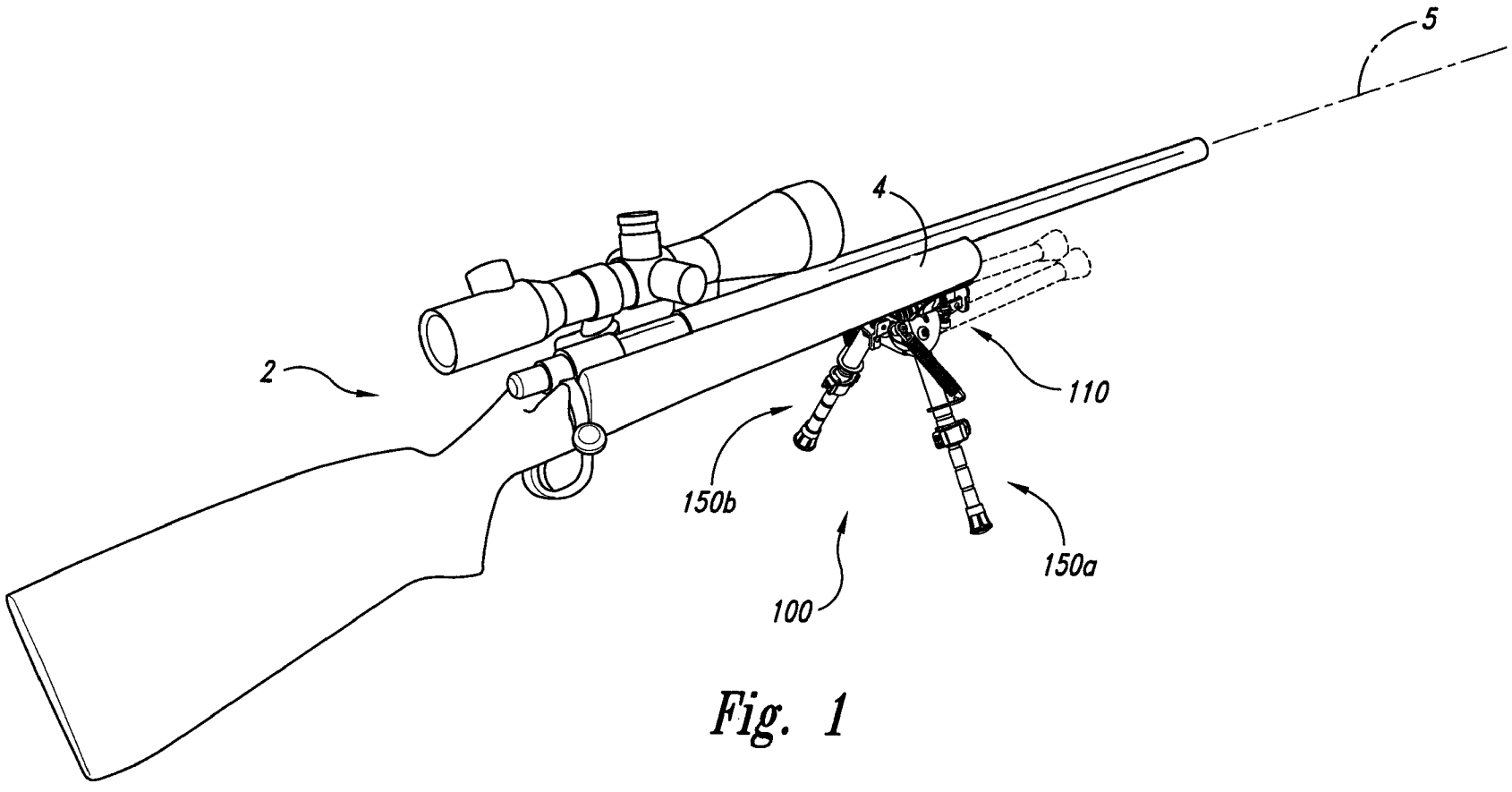
FIG. 1 is an isometric view of a firearm operably coupled to a firearm support assembly configured in accordance with an embodiment of the disclosure.

The following disclosure describes several embodiments of supports and bipods for supporting a firearm. One aspect of the disclosure is directed to an adjustable bipod assembly that includes several components that are made from a corrosion resistant nonferrous metal or alloy such as titanium or a titanium alloy. In one embodiment, for example, the bipod assembly includes a stock mount assembly configured to support a forestock of the firearm, and an attachment assembly carried by the stock mount assembly and configured to releasably attach to the forestock of the firearm. The stock mount assembly can include a titanium support plate, and at least a portion of the attachment assembly can be titanium. The bipod assembly further includes first and second legs operably coupled to the support plate, wherein at least a portion of each of the legs can also be titanium. The legs can pivot between a stowed position in which the legs are generally parallel to a longitudinal axis of the firearm, and an extended position in which the legs are generally transverse to the longitudinal axis of the firearm. The titanium components of the bipod assembly provide a relatively lightweight bipod assembly that has corrosion resistant properties without requiring exterior surface treatment.

Another aspect of the disclosure is directed to a bipod assembly including a stock mount assembly that is rotatable relative to a longitudinal axis of the firearm. In one embodiment, for example, the bipod assembly includes a first plate that is operably coupled to a second plate, and a cam lever that moves a tension screw in a direction generally parallel to the longitudinal axis of the firearm. The tension screw is movable between a first position that locks the first plate with reference to the second plate, and a second position that allows the first plate to rotate with reference to the second plate. The bipod assembly also includes an attachment assembly that is carried by the stock mount assembly and that is configured to releasably attach to the forestock. The bipod assembly further includes first and second adjustable legs extending from the stock mount assembly.

In yet another embodiment, the bipod assembly can include a stock mount assembly including a first plate operably coupled to a second plate, and first means for locking the first plate with reference to the second plate. The bipod assembly also includes an attachment assembly carried by the stock mount assembly. The attachment assembly is configured to attach to the forestock of the firearm and includes second means for adjusting a tension of the attachment assembly. The bipod assembly further includes a pair of legs operably coupled to the first plate. Each leg includes third means for adjusting a length of the leg.

Where the context permits, singular or plural terms may also include the plural or singular terms, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features or other types of features and components are not precluded.

The headings provided herein are for convenience only and do not provide any interpretation of the scope or meaning of the claimed inventions.

B. Embodiments of Firearm Support Assemblies

FIG. 1 is an isometric view of a firearm 2 that is attached to a firearm support assembly 100 ("support 100") configured in accordance with one embodiment of the disclosure. In the illustrated embodiment, the support 100 includes a stock mount assembly 110 that is configured to releasably attach to the forestock 4 of the firearm 2. Support members or legs 150 (identified individually as a first leg 150*a* and a second leg 150*b*) extend from the stock mount assembly 110 and provide an adjustable support for the forestock 4 of the firearm 2. According to one aspect of the illustrated embodiment, the legs 150 are movable between a support position as shown in FIG. 1, and a stowed position as shown in broken lines. More specifically, the legs 150 extend in a direction generally perpendicular to a longitudinal axis 5 of the firearm 2 when they are in the support position. The legs 150 can pivot relative to the stock mount assembly 110 to move into the stowed position in a direction generally parallel to the longitudinal axis 5 of the firearm 2.

Figure 2A:
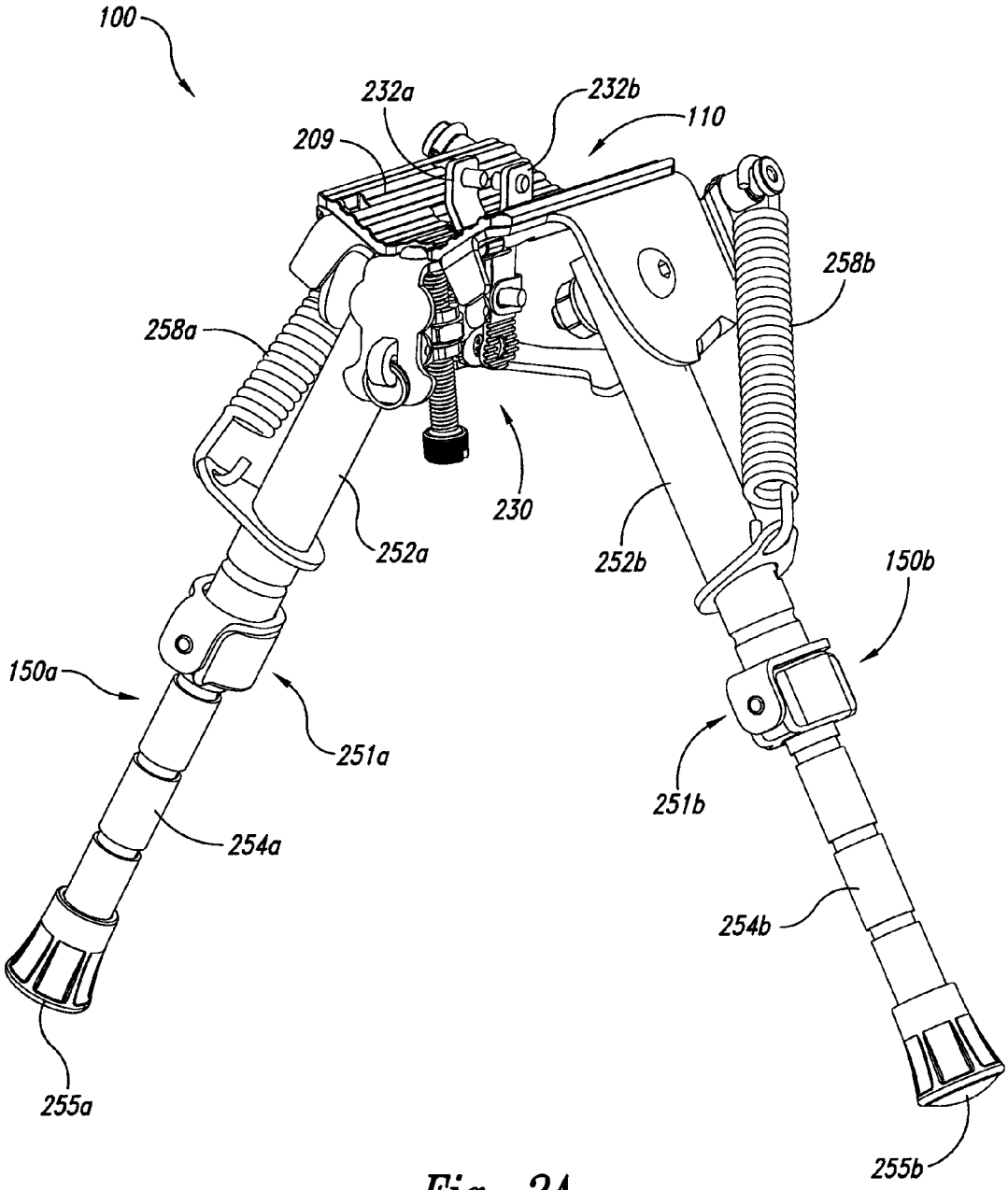
FIG. 2A is an isometric view.
Figure 2B:
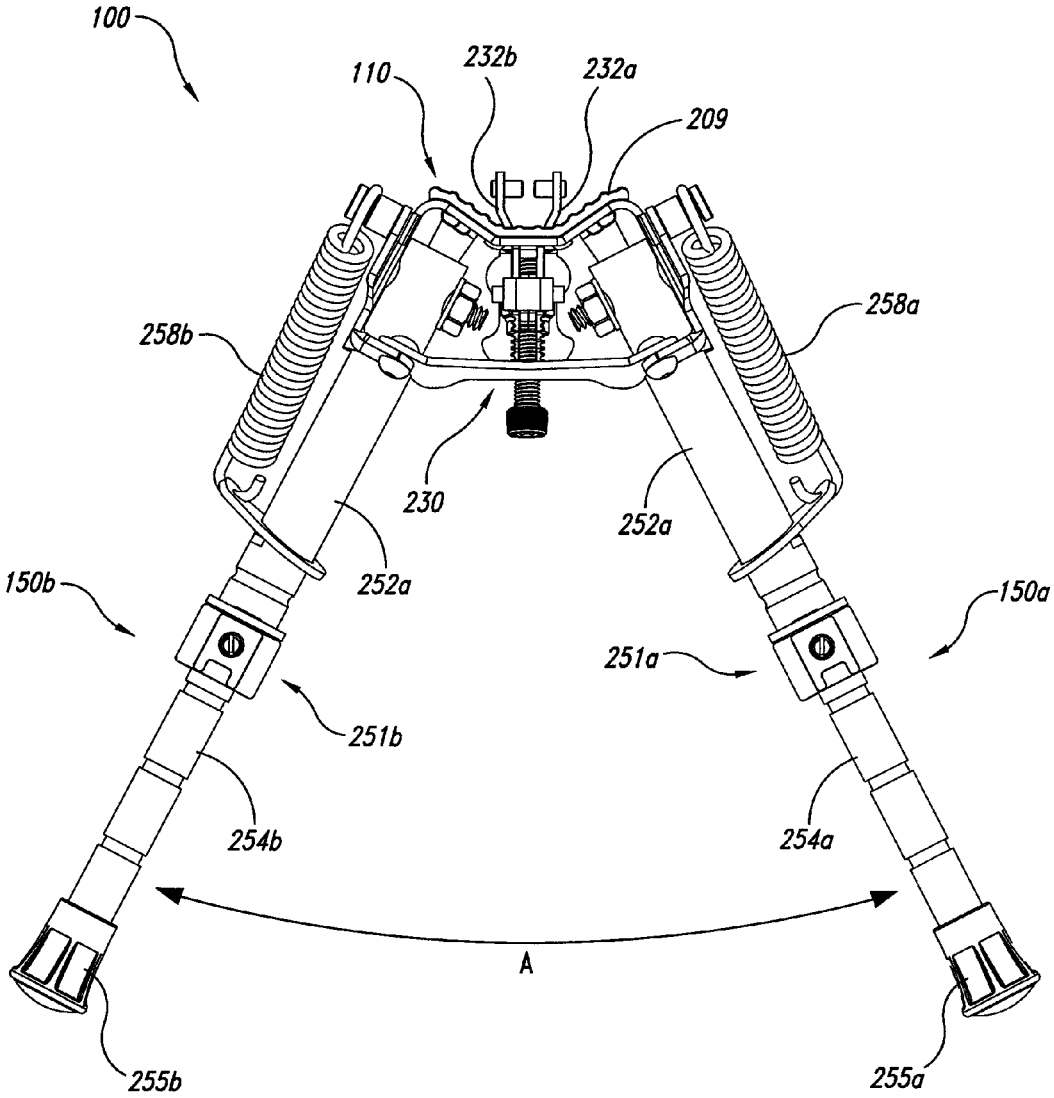
FIG. 2B is a rear view.
Figure 2C:
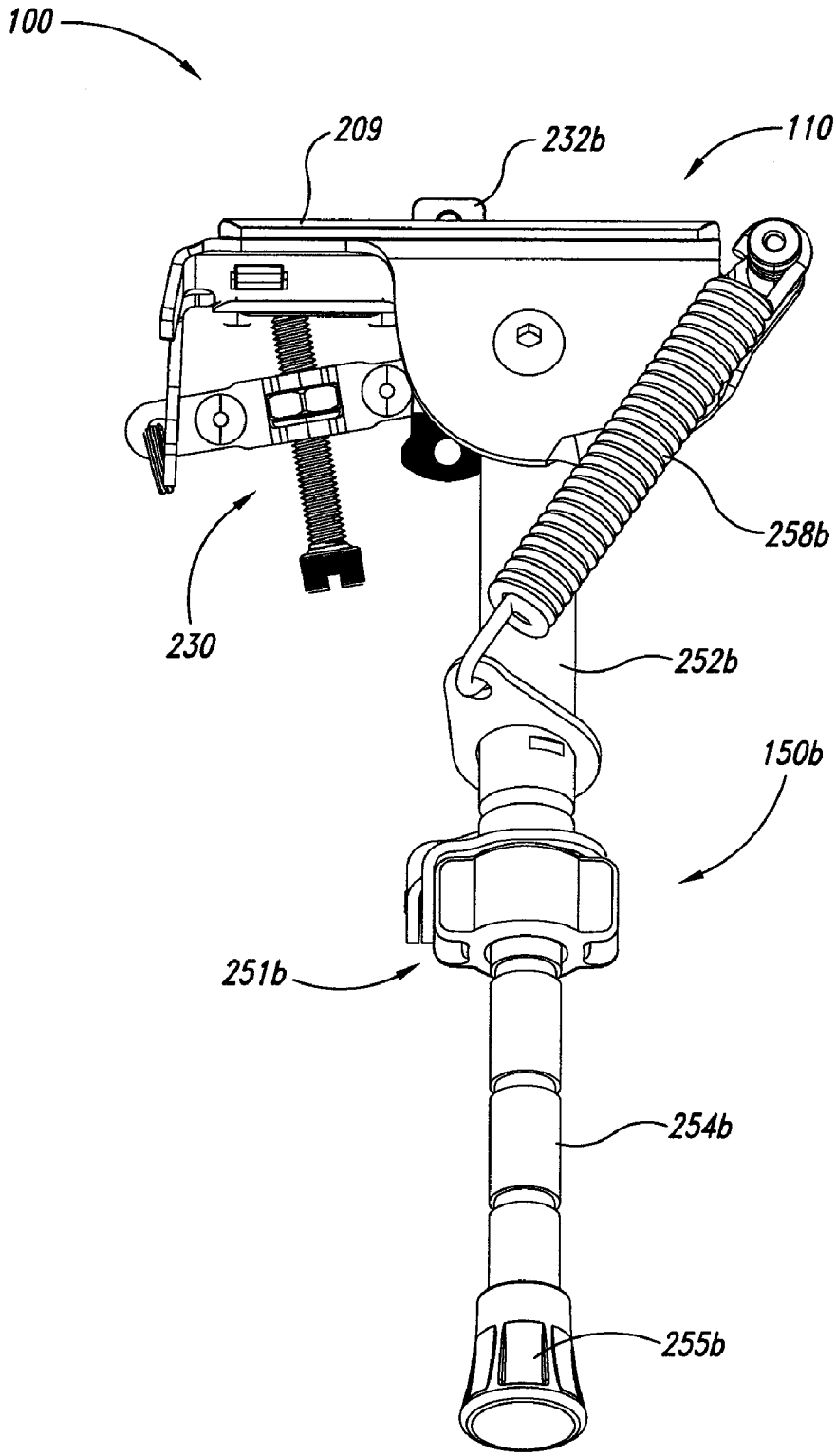
FIG. 2C is a left side view.
Figure 2D:
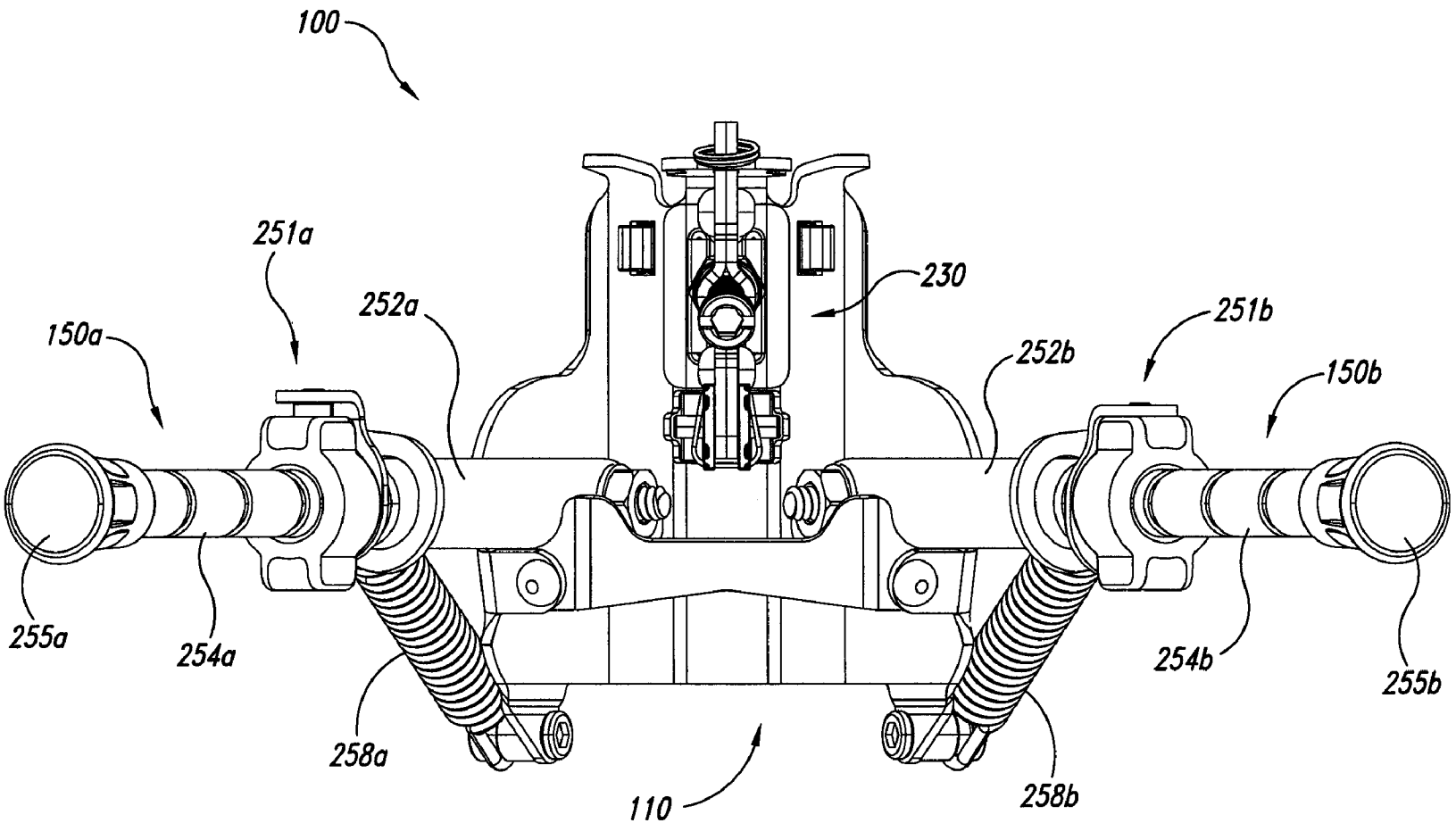
FIG. 2D is a bottom plan view of the firearm support assembly of FIG. 1.

FIG. 2A is an isometric view, FIG. 2B is a rear view, FIG. 2C is a left side view, and FIG. 2D is a bottom plan view of the support 100 of FIG. 1. Referring to FIGS. 2A-2D together, the illustrated embodiment includes a pad 209 carried by the stock mount assembly 110. The pad 209 is configured to mate with the forestock 4 of the firearm 2 (FIG. 1) and can be made from a durable non-marring material (e.g., rubber, elastomer, foam, leather, etc.). According to alternative embodiments, the pad 209 is eliminated and a top surface of the stock mount assembly 110 is configured to mate with the forestock 4 of the firearm 2 (FIG. 1). An adjustment assembly 230 is operably coupled to the stock mount assembly 110 to releasably attach to the firearm 2. As described in detail below with reference to FIG. 4, the attachment assembly 230 includes attachment members 232 (individually identified as a first attachment member 232*a* and a second attachment member 232*b*) extending through the stock mount assembly 110 to engage a sling swivel stud or other component of the firearm 2.

The support 100 further includes biasing members or springs 258 (individually identified as a first spring 258*a* and a second spring 258*b*) operably coupled to the stock mount assembly 110 and each of the legs 150. Each spring 258 retains the corresponding leg 150 in the extended position or in the stowed position (FIG. 1). As described in detail below with reference to FIG. 5, each leg 150 includes an upper leg portion 252 (individually identified as a first upper leg portion 252*a* and a second upper leg portion 252*b*) that slidably receives a corresponding lower leg portion 254 (individually identified as a first lower leg portion 254*a* and a second lower leg portion 254*b*). The lower leg portions 254 can independently slide into and out of the upper leg portions 252 to adjust the height of the support 100 or accommodate uneven terrain.

The support 100 also includes locking assemblies 251 (individually identified as a first locking assembly 251*a* and a second locking assembly 251*b*) that are operably coupled to the corresponding upper leg portions 252 to retain the lower leg portions 254 at a desired position extending axially from the upper leg portions 252. When the legs 150 are in the extended position and pivoted away from the stock mount assembly 110, the legs 150 open to an angle A (FIG. 2B). Each lower leg portion 254 also includes a foot 255 (individually identified as a first foot 255*a* and a second foot 255*b*) that can be made from a non-slip or resilient material (e.g., rubber, plastic, etc.). In one embodiment, each foot 255 can be attached to the corresponding lower leg portion 254 without the use of a mechanical fastener. For example, the feet 255 can be attached to the lower leg portions 254 with an adhesive.

According to one feature of the illustrated embodiment, the support 100 is relatively light weight with reference to the firearm 2 (FIG. 1). More specifically, and as described in detail below, several of the components of the support 100 can be made from a corrosion resistant nonferrous metal or alloy such as titanium or aluminum to allow the support 100 to be lighter than conventional firearm supports. As used herein, titanium is intended to include pure titanium and titanium alloyed materials. Moreover, the titanium components of the support 100 are also corrosion resistant by virtue of the material properties of titanium. Accordingly, certain components or all of the components of the support 100 can be made from titanium to take advantage of the high strength to weight ratio of titanium and to avoid surface treatment processing steps (e.g., anodizing) for corrosion purposes. In other embodiments, however, portions or all of the support 100 can be made from other materials that are suitable for firearm supports (e.g., aluminum, steel, alloys, etc.).

Figure 3:
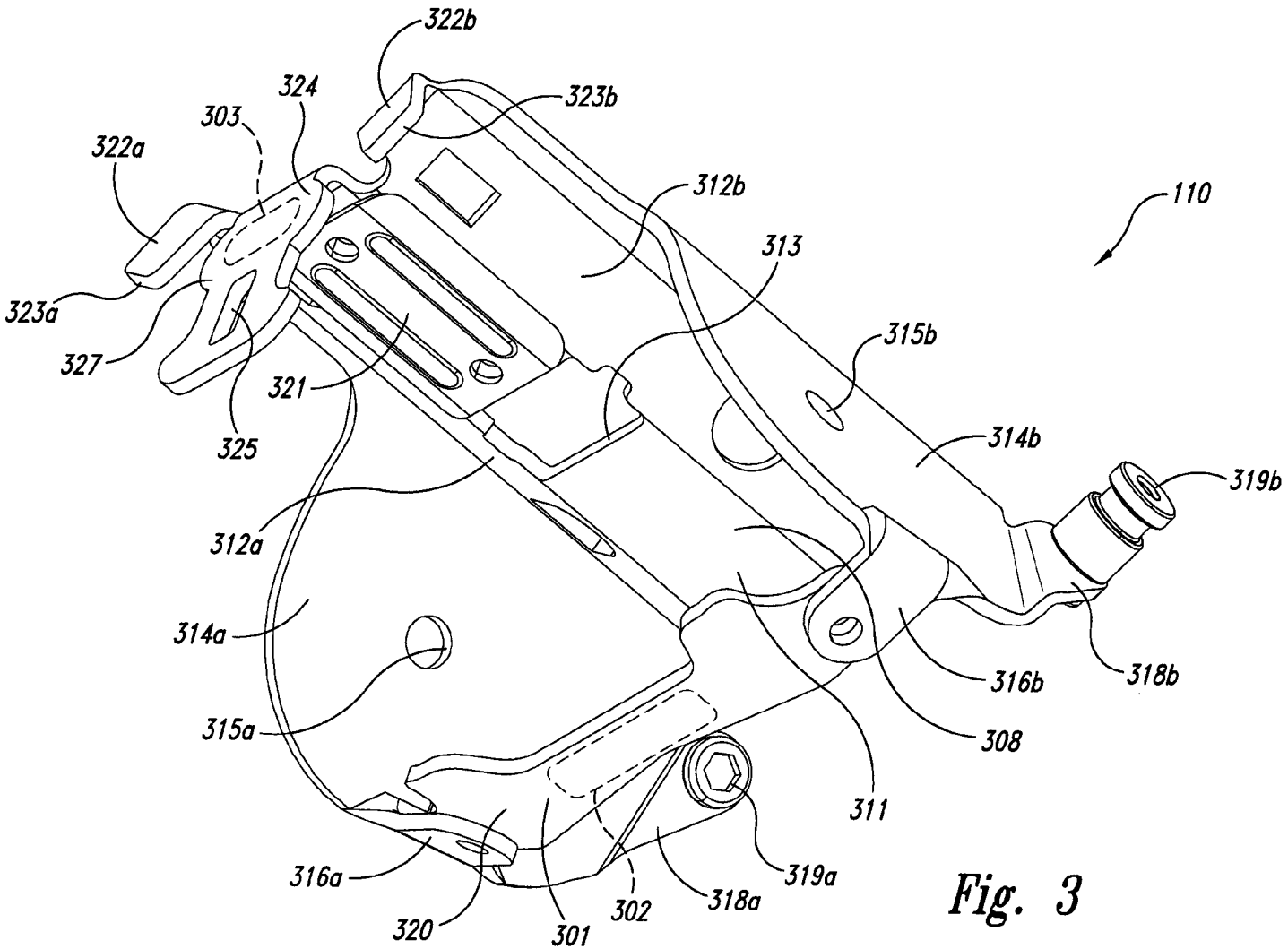
FIG. 3 is an isometric view of a portion of a stock mount assembly configured in accordance with an embodiment of the disclosure.

FIG. 3 shows an isometric view of an attachment portion of the stock mount assembly 110. In the illustrated embodiment, the stock mount assembly 110 includes a support plate 308 that is configured to receive the forestock 4 of the firearm 2, as well as support the legs 150 and attachment assembly 230. The support plate 308 includes side forestock support portions 312 (individually identified as a first forestock support portion 312*a* and a second forestock support portion 312*b*) extending from a middle portion 311 in a generally U-shaped configuration to receive the forestock 4. The forestock support portions 312 can also be configured to carry one or more pads 209 (FIG. 2A).

The stock mount assembly 110 further includes leg support portions 314 (individually identified as a first leg support portion 314*a* and a second leg support portion 314*b*) extending at an angle from the corresponding forestock support portions 312. Each leg support portion 314 includes a leg attachment opening 315 (individually identified as a first leg attachment opening 315*a* and a second leg attachment opening 315*b*) to receive a fastener (e.g., screw, bolt, rivet, etc.) for pivotal attachment to the corresponding leg 150. Each leg support portion 314 also includes spring flanges 318 (individually identified as a first spring flange 318*a* and a second spring flange 318*b*). Each spring flange 318 extends generally parallel from the corresponding leg support portion 314 and includes a post 319 (individually identified as a first post 319*a* and a second post 319*b*) to be operably coupled to the corresponding springs 258 (FIG. 2A).

Each leg support portion 314 also includes a brace flange 316 (individually identified as a first brace flange 316*a* and a second brace flange 316*b*). The brace flanges 316 extend from the leg support portions 314 toward each other and are attached to a brace member 320. According to one feature of the illustrated embodiment, the brace member 320 is formed from a generally flat or planar piece of material. For example, in one embodiment the support plate 308 and the brace member 320 can be made from a stamping manufacturing process. In this manner, the brace member 320 can be made from the parent stamping material of the support plate 308. According to one feature of this embodiment, the support plate 308 and the brace member 320 can be made from a corrosion resistant nonferrous metal or alloy such as titanium or aluminum.

The planar brace member 320 in the illustrated embodiment provides a generally flat first mounting surface 301 for a first label 302 (shown in broken lines). In certain embodiments, the first label 302 can include a plaque or decal with reference indicia such as a company logo, model name, specifications, advertising, etc. Moreover, the first label 302 can be attached to the first mounting surface 301 of the brace member 320 with an adhesive, mechanical fastener, etc. One advantage of positioning the first label 302 on the generally planar brace member 320 is that the first mounting surface 301 is the most visible when the attached firearm 2 is standing up in a gun rack. For example, when the legs 150 are in the stowed position and the firearm 2 is resting vertically in a gun rack, the first mounting surface 301 faces outwardly from the firearm 2 to display the first label 302.

In the illustrated embodiment, the support plate 308 further includes stop portions 322 (individually identified as a first stop portion 322*a* and a second stop portion 322*b*) extending from the middle portion 311. Each stop portion 322 includes a stop surface 323 (individually identified as a first stop surface 323*a* and a second stop surface 323*b*) that is configured to contact and stop the pivotal movement of the legs 150 when they in the stowed position (as shown in FIG. 1 in broken lines).

According to another feature of the illustrated embodiment, the support plate 308 also includes an attachment assembly mounting portion 324 extending generally perpendicularly from the middle portion 311 between the stop portions 322. The attachment assembly mounting portion 324 includes a slot 325 for receiving the adjustment assembly 230 (FIG. 2A), and a generally planar or flat second mounting surface 327 that is configured to receive a second label 303. The second label 303 can be generally similar to the first label 302 and attached to the second mounting surface 327 with an adhesive, mechanical fastener, etc.

In the illustrated embodiment, the stock mount assembly 110 also includes a screw plate 321 attached to the middle portion 311 of the support plate 308 proximate to the attachment assembly mounting portion 324. The middle portion 311 also includes an opening 313 extending therethrough proximate to the screw plate 321 to receive the attachment members 232 of the attachment assembly 230 (FIG. 2A). As explained in detail below with reference to FIG. 4, the screw plate 321 is configured to provide a reinforcing material to adjust a tension of the attachment assembly 230. In other embodiments, however, the stock mount assembly 110 can be configured to omit the screw plate 321.

In one embodiment, the support plate 308 and associated portions described above can be formed from a single piece of material. More specifically, the support plate 308 can include a single piece of material that can be stamped and bent into the desired shape. As noted above, the brace member 320 can also be stamped from the same material as the support plate 308. In one embodiment, the support plate 308 and all of its integral portions can be formed from a corrosion resistant nonferrous metal or alloy such as titanium, aluminum or a titanium alloy. In other embodiments, however, these components can be formed from other materials suitable for forming a firearm support 100, such as steel or other ferrous metals and alloys.

Figure 4:
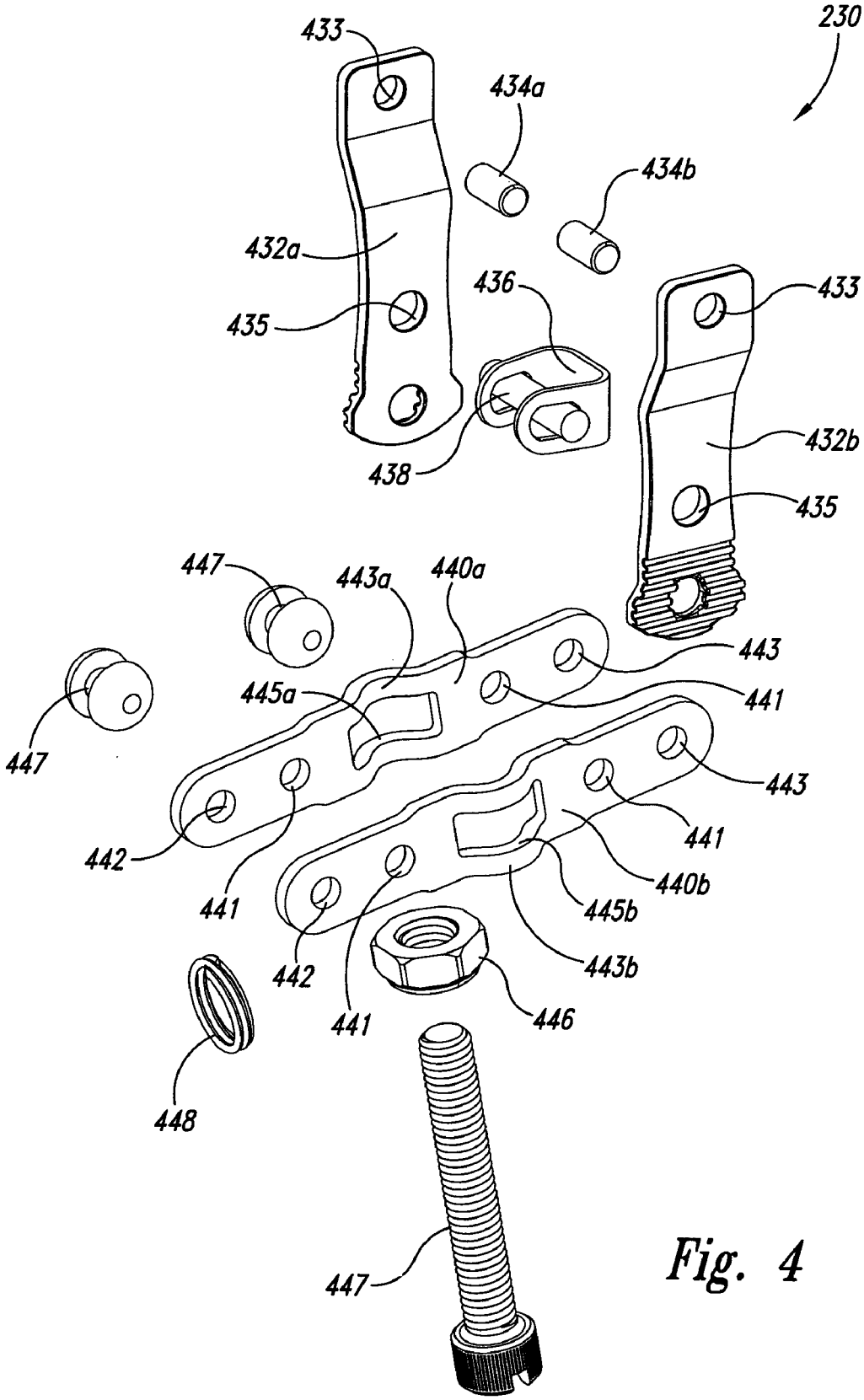
FIG. 4 is an exploded isometric view of an attachment assembly configured in accordance with an embodiment of the disclosure.

FIG. 4 shows an exploded isometric view of the attachment assembly 230. In the illustrated embodiment, the attachment assembly 230 includes tension arms 440 (individually identified as a first tension arm 440*a* and a second tension arm 440*b*) operably coupled to side arms 432 (individually identified as a first side arm 432*a* and a second side arm 432*b*). More specifically, the tension arms 440 are attached to each other with multiple fasteners 447 (shown in FIG. 4 as rivets) inserted through corresponding opening 441. A ring clip 448 is inserted through corresponding second openings 442 in the tension arms 440. The ring clip 448 movably retains the tension arms 440 in the slot 325 in the attachment assembly mounting portion 324 of the support plate 308 (as best shown in FIG. 2C). Each tension arm 440 includes a curved middle portion 443 (individually identified as a first middle portion 443*a* and a second middle portion 443*b*) configured to accommodate a locknut 446 and having a slot 445 (individually identified as a first slot 445*a* and a second slot 445*b*) formed therein. The locknut 446 is captured between the curved portions 443 in the slots 445, and a tension member or thumb screw 447 is threadably engaged with the locknut 446.

A retainer pin 438 operably couples the side arms 432 to the tension arms 440. More specifically, the retainer pin 438 is received in openings 443 in the tension arms 440, as well as in openings 435 in the side arms 432. A generally U-shaped retainer plate 436 is positioned around the side arms 432 and the end portions of the retainer pin 438. In this manner, each side arm 432 can independently pivot with reference to the tension arms 440. Engagement pins 434 (individually identified as a first engagement pin 434*a* and a second engagement pin 434*b*) are retained (e.g., press-fit) into corresponding openings 433 in the side arms 432 to engage and retain the forestock 4 of the firearm 2 (FIG. 1). For example, the side arms 432 and associated engagement pins 434 can be releasably attached to a sling swivel stud (not shown) on the forestock 4.

In operation, the attachment assembly 230 is moveable relative to the stock mount assembly 110 to attach the support 100 to the firearm 2. The tension arms 440 can pivot with reference to the attachment assembly mounting portion 324 of the support plate 308 to move the side arms 432 into and out of the attachment opening 313 (FIG. 3). When the engagement pins 434 are removably attached to a forestock 4 of a firearm 2, the thumb screw 447 can be rotated in the locknut 446 to draw the side arms 432 and corresponding engagement pins 434 attached to the forestock 4 toward the support plate 308. More specifically, an end portion of the thumb screw 447 can contact and rotate against the screw plate 321 (FIG. 3). As the thumb screw 447 rotates, the locknut 446 travels axially along the thumb screw 447 away from the support plate 308 to pull the side arms 432 and increase the retention force of the engagement pins 434.

According to one feature of the embodiment illustrated in FIG. 4, the captured locknut 446 prevents the thumb screw 447 from backing out or inadvertently loosening when the attachment assembly is attached to a firearm 2. During operation of the firearm, recoil has traditionally caused attachment mechanisms from loosening up, according to features of the illustrated embodiment, the locknut prevents the thumb screw 447 from backing out during operation of the firearm, while the firearm support is in a stored position, or while the firearm support is supporting the firearm. Another feature of the illustrated embodiment is that the locknut 446 can be a standard hardware fastener with internal threads. For example, the locknut 446 can be a hexagonal locknut with metallic or nylon threads. As such, the thumb screw 447 of the illustrated embodiment threadably engages a locknut 446 having predictable threads that can be formed from high-quality material. Moreover, forming the locknut 446 does not require extensive manufacturing processes because a standard hardware fastener can be used. In other embodiments, the locknut 446 can be made from other materials suitable for engaging the thumb screw 447, such as, for example, nylon, plastic, or other non-metallic materials.

Figure 5:
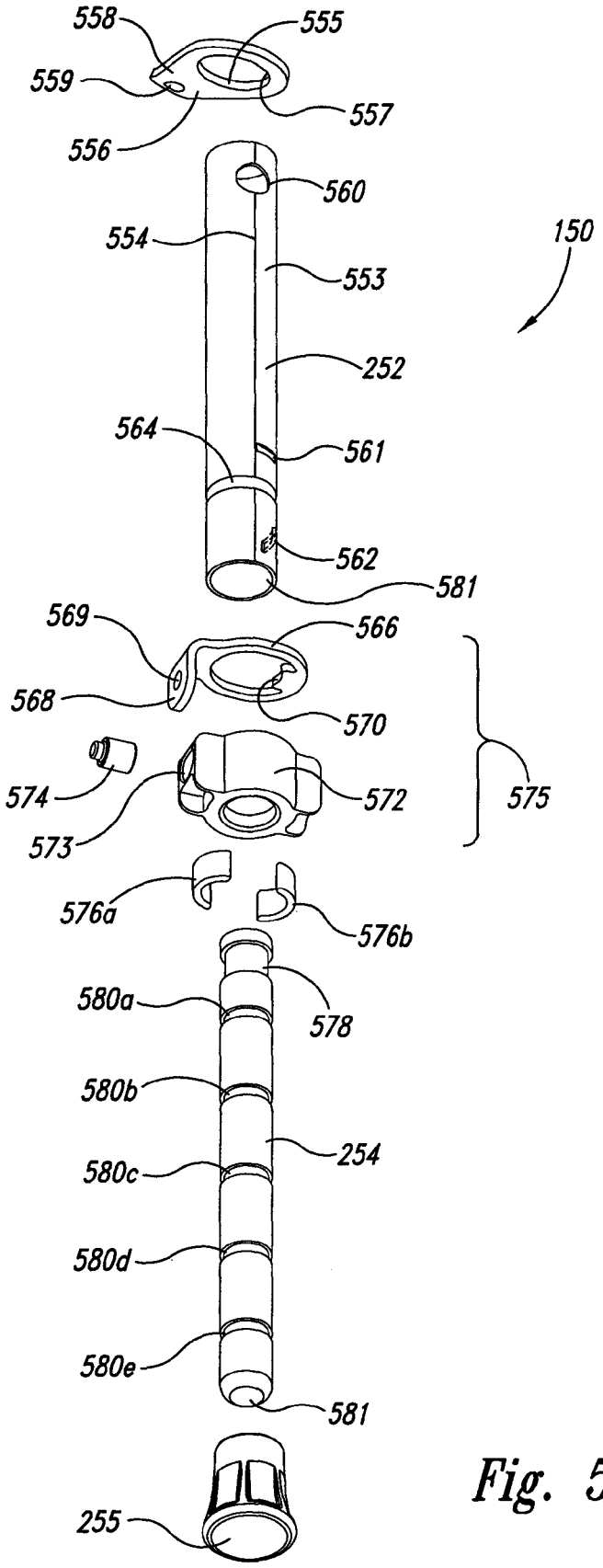
FIG. 5 is an exploded isometric view of a leg of the firearm support assembly configured in accordance with an embodiment of the disclosure.

FIG. 5 shows an exploded isometric view of one of the legs 150. In the illustrated embodiment, the upper leg portion 252 has a generally cylindrical hollow body 553. In one embodiment, the body 553 is made from a corrosion resistant nonferrous metal or alloy such as titanium and is formed rolling and welding process. More specifically, the body 553 can include a welded seam 554 extending axially along the body. The body 553 also includes an attachment opening 560 that is configured to receive a fastener (not shown) to attach the leg 150 to the stock mount assembly 110. The leg 150 also includes a spring retaining member 556 that is configured to operably couple the body 553 of the upper leg portion 252 to the spring 258 (FIG. 2A). More specifically, the spring retaining member 258 includes a generally circular opening 555 having a diameter that is slightly greater than an outer diameter of the body 553. The opening 555 includes a generally planar portion 557. The spring retaining member 556 also includes and extension portion 558 having an aperture 559 that is configured to releasably attach to the spring 258. When the attached spring 258 is in tension, the opening 555 of the spring retaining member 556 is angled with reference to the body 553 of the upper leg portion 252 to prevent the spring retaining member 556 from sliding axially along the body 553 of the upper leg portion 252.

In the illustrated embodiment, the hollow body 553 is configured to slidably receive and retain at least a portion of the lower leg portion 254. More specifically, the upper leg portion 252 includes a groove 564 having a first inner diameter $ID_1$ (not shown) that is less than a second inner diameter $ID_2$ (not shown) of the body 553. In one embodiment, the groove 564 can be formed in a rolling manufacturing process in the upper leg portion 252. In other embodiments, however, the groove 564 can be formed using other manufacturing methods. The lower leg portion 254 includes a first slot 578 that is configured to receive and retain bushings or retention members 576 (individually identified as a first retention member 576*a* and a second retention member 576*b*). When the retention members 576 are positioned in the first slot 578, the retention members 576 have a combined outer diameter OD (not shown) that is greater than the first inner diameter $ID_1$ of the groove 564 but less than the second inner diameter $ID_2$ of the body 553 of the upper leg portion 252. In this manner, the lower leg portion 254 can slide within the upper leg portion 252 to extend therefrom, until the retaining members 576 contact the groove 564 in the body 553 of the upper leg portion 252.

Another feature of the illustrated embodiment is that the lower leg portion 254 can be locked in incremental positions extending out of the upper leg portion 252. More specifically, the lower leg portion 254 includes a plurality of spaced apart slots or channels 580 (individually identified as first through fifth channels 580*a*-580*e*). The leg 150 also includes a locking assembly 575 that removably engages the channels 580. The locking assembly 575 can be removably attached to the end portion of the upper leg portion 252. The locking assembly 575 includes a plunger housing 572 having an opening 573 that receives a spring-loaded plunger 574. A retaining ring 566 is positioned on top of the plunger housing 572 and includes a flange 568 having an opening 569 that engages the plunger 574. The retaining ring 566 also includes a tab 570 extending toward an interior portion of the retaining ring 566. The tab 570 is configured to extend into the body 558 of the upper leg portion 252 through a corresponding slot 562 (shown in broken lines). The tab 570 is configured to engage one of the channels 580 as the lower leg portion 254 slides in or out of the upper leg portion 252. The tab 570 disengages the slot 580 as the flange 568 of the retaining ring 566 is pushed toward the plunger 574 to depress the plunger 574 and move the entire retaining ring 566.

According to another feature of the illustrated embodiment, a lower portion of the plunger housing 572 can cover a lower edge 581 of the upper leg portion 252. More specifically, a lower portion of the plunger housing 572 can have an inner diameter 579 that is smaller than the outer diameter of the body 553 of the upper leg portion 252, and also smaller than the combined outer diameter OD of the retention members 576. In this manner, the inner diameter 579 of the lower portion of the plunger housing 572 can act as a stop against the retention members 576 to limit the extension of the lower leg portion 254 from the upper leg portion 252.

According to yet another feature of the illustrated embodiment, the plunger housing 572 can have a die-cast geometry. For example, the plunger housing 572 can include draft angles and parting lines suitable for die-casting manufacturing processes. One advantage of utilizing die-cast geometries for the plunger housing 572 is that the plunger housing 572 can be designed to be light weight plunger housing 572. Moreover, several of the components of the leg 150 illustrated in FIG. 5 can be made from light weight titanium or aluminum. For example, the upper leg portion 252, the lower leg portion 254, the retaining ring 566, the plunger 574, and/or the retention members 576, can be made from aluminum, titanium or titanium alloys. In other embodiments, however, some or all of these components can be made from other suitable materials for firearm supports, for example, nonferrous metals or alloys, or ferrous metals or alloys.

In addition to the weight saving benefits, a further advantage of forming the upper leg portion 252 from nonferrous metal such as titanium is that the upper leg portion 252 can be attached to the stock mount assembly 110 without any reinforcement on or near the attachment opening 560. The combination of an increased strength with light weight and corrosion resistance provides desirable advantages for a firearm support assembly. The light weight allows the support assembly to be easily carried while attached to the firearm; the corrosion resistance allows the firearm support assembly to be used in all weather conditions; and the increased strength provides a more durable firearm support.

Figure 6A:
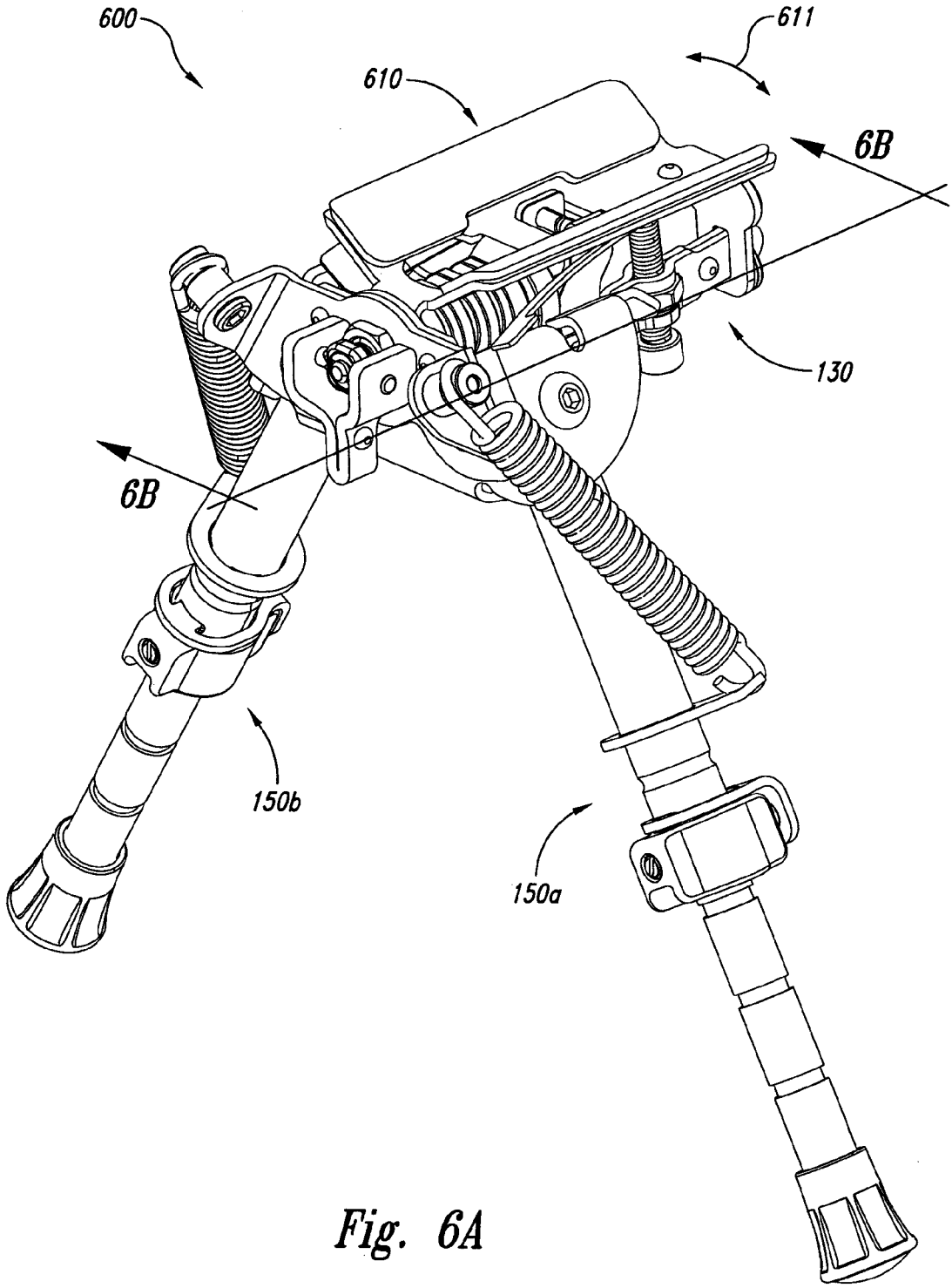
FIG. 6A is an isometric view and FIG. 6B is a partial side view of a firearm support assembly configured in accordance with another embodiment of the disclosure.

FIG. 6A shows an isometric of a firearm support 600. In the embodiment illustrated in FIG. 6A, the firearm support is generally similar in structure and function to the firearm support 100 described above with reference to FIGS. 1-5. For example, the illustrated firearm support 600 includes the attachment assembly 130 and adjustable legs 150. In the embodiment illustrated in FIG. 6A, however, the firearm support 600 includes a stock mount assembly 610 that is configured to rotate or swivel about the longitudinal axis 5 of the firearm 2 (FIG. 1). More specifically, the stock mount assembly 610 is configured to rotate or swivel with reference to the legs 150 in directions indicated by the double-headed arrow 611.

Figure 6B:
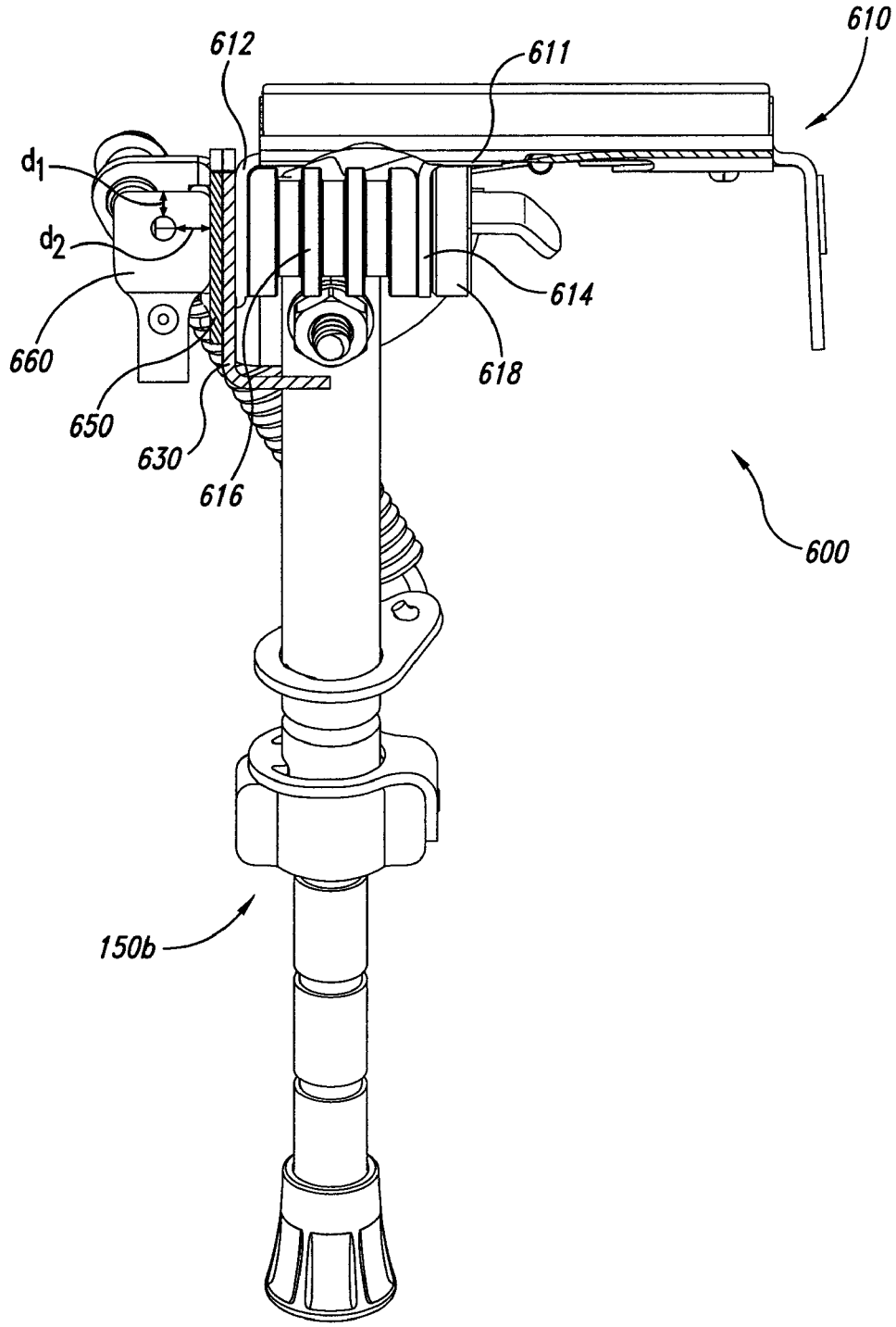

FIG. 6B shows a partial side view of the firearm support 600 taken along the line 6B-6B of FIG. 6A. As shown in the illustrated embodiment, the stock mount assembly 610 includes a first stock mount plate 611 having a first extension portion 612 and a second extension portion 614. A swivel bushing 616 is operably coupled between the first extension portion 612 and the second extension portion 614. A swivel bushing cap 618 retains the swivel bushing 616 in position with reference to the second extension portion 614. The stock mount assembly 610 further includes a second stock mount plate 630 and a third stock mount plate 650 positioned between a cam lever 660 and the first extension portion 612 of the first stock mount plate 611. As explained in detail below, the cam lever 660 is configured to move a tension screw (not shown in FIG. 6B) relative to the swivel bushing 616 to lock or unlock the rotation of the stock mount assembly 610.

Figure 7:
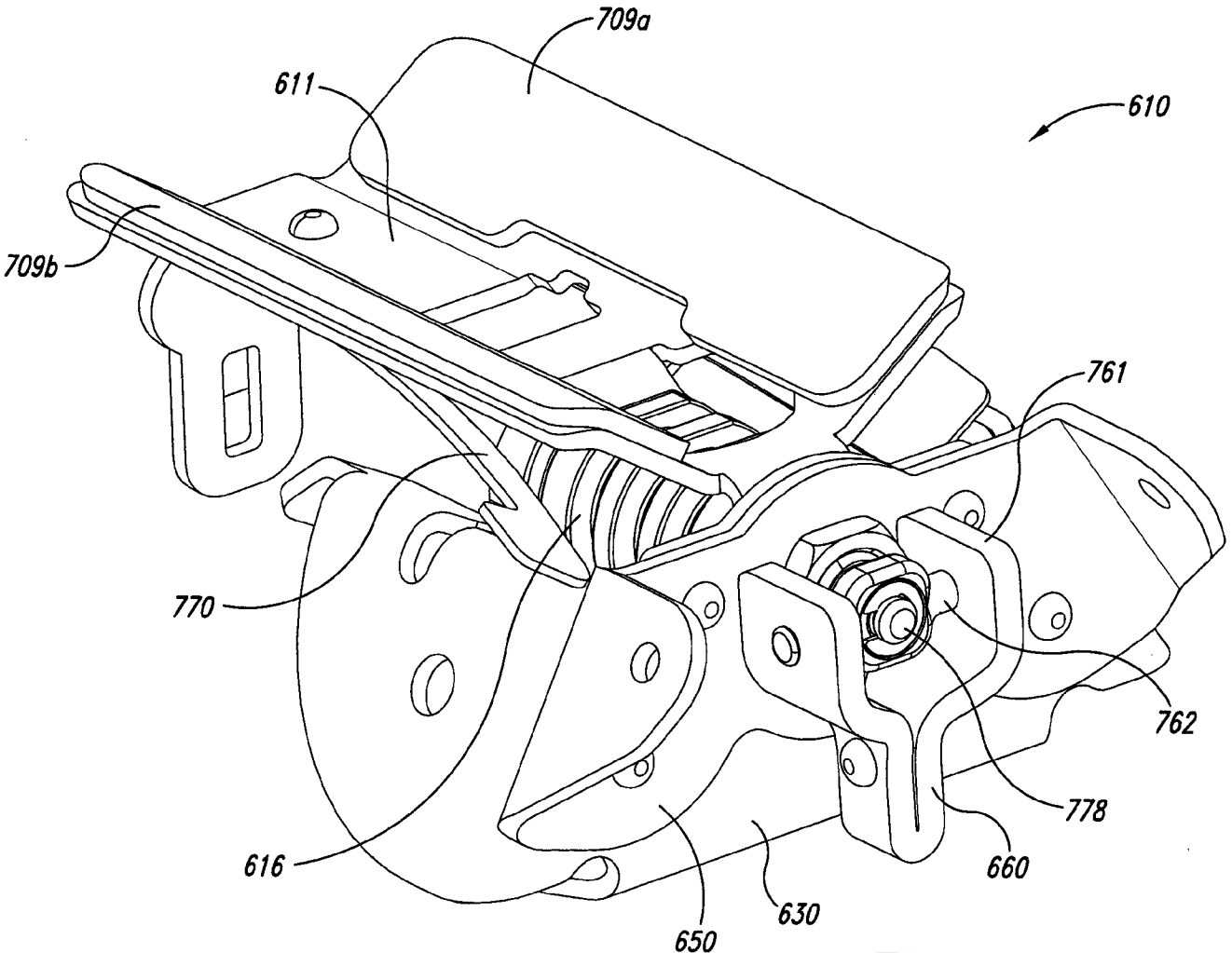
FIG. 7 is an isometric view of a stock mount assembly configured in accordance with an embodiment of the disclosure.

FIG. 7 shows an isometric view of the stock mount assembly 610. In the illustrated embodiment, the first stock mount plate 611 has a generally U-shaped configuration and carries pads 709 (individually identified as a first pad 709*a* and a second pad 709*b*) to contact a firearm (FIG. 1). A spring plate 770 (only a portion of which is visible in FIG. 7) is attached to the first stock mount plate 611 to bias the first stock mount plate 611 in a generally centered position with reference to the second stock mount plate 630. In the illustrated embodiment, the cam lever 660 is configured to move a cam bushing 762 that is coupled to the tension screw 778. More specifically, in the position shown in FIG. 7, the cam lever 660 pulls the cam bushing 762 to position the tension screw 778 so that the first stock mount plate 611 is in a locked position with reference to the second mount plate 630. When the cam lever 660 is pivoted about the cam bushing 762, a contact surface 761 of the cam lever 660 contacts the third stock mount plate 650. This movement changes the distance between the cam bushing 762 and the second stock mount plate 630 to move the tension screw 778 into the swivel bushing 616 and unlock the rotation of the second stock plate 630 with reference to the first stock mount plate 611.

Figure 8:
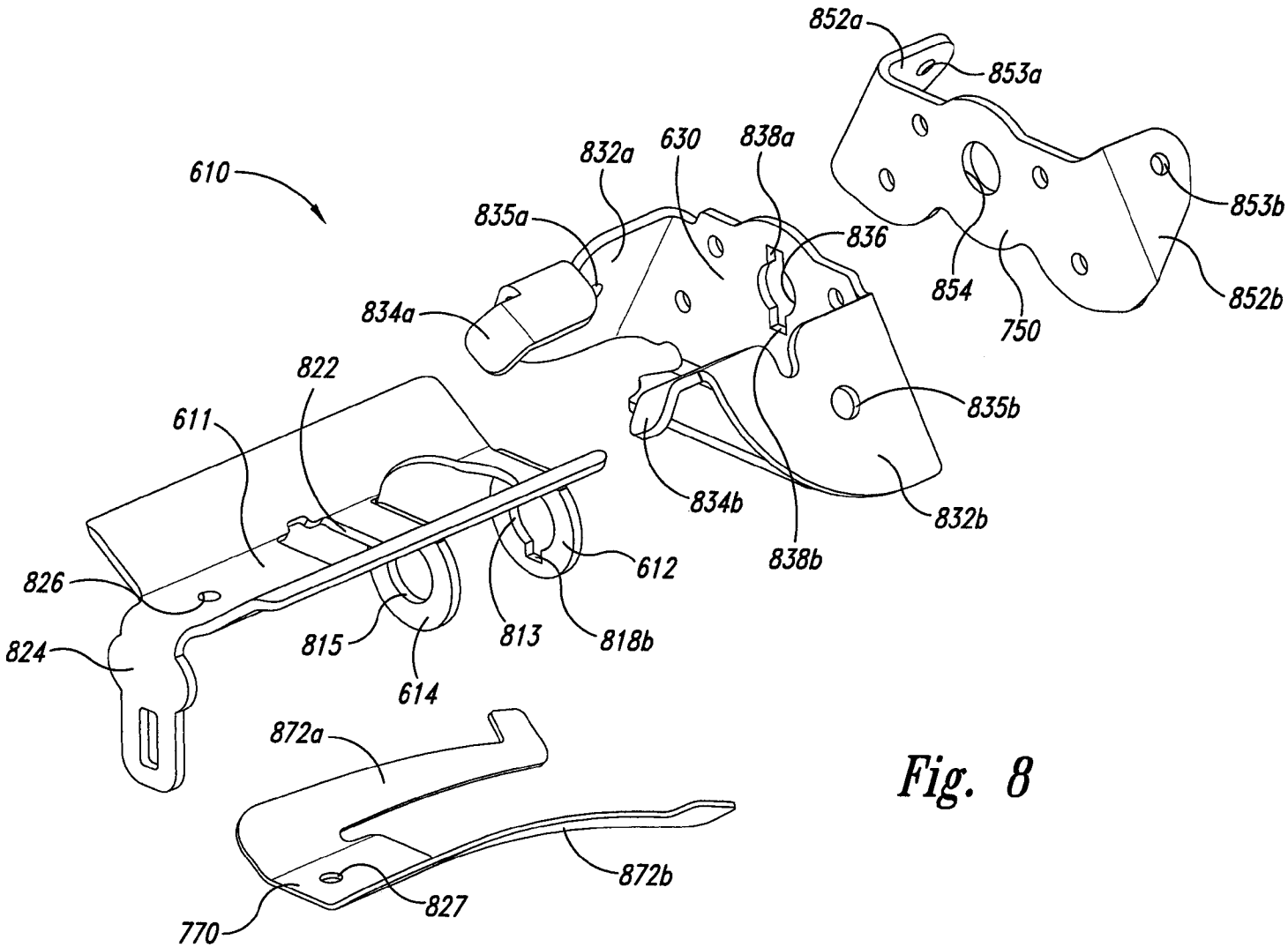
FIGS. 8 and 9 are exploded isometric views of the stock mount assembly of FIG. 7.

FIG. 8 is an exploded isometric view of several components of the stock mount assembly 610. In the illustrated embodiment, the first stock mount plate 611 includes an attachment assembly mounting portion 824 and an attachment assembly opening 822, each of which are configured to receive an attachment assembly generally similar in structure and function to the attachment assembly 230 described above with reference to FIGS. 2A-2D and 4. The first extension portion 612 of the first stock mount plate 611 includes a generally circular first opening 813 having two spaced apart key portions 818 (only a second key portion 818*b* is visible in FIG. 8). In the illustrated embodiment, the key portions 818 each have a generally rectilinear shape extending from the first opening 813. In other embodiments, however, the key portions 818 can have other shapes or configurations. The second extension portion 614 also includes a generally circular second opening 815 aligned with the first opening 813.

The first stock mount plate 611 also includes a spring plate attachment aperture 826 that is configured to be aligned with a corresponding aperture 827 on the spring plate 770 for attachment thereto (e.g., with a fastener). The spring plate 770 includes arms 872 (individually identified as a first arm 872*a* and a second arm 872*b*) that are configured to contact the second stock mount plate 630 to bias the first stock mount plate 611 in a generally centered position with reference to the second stock mount plate 630.

In operation, the second stock mount plate 630 includes a generally circular opening 836. The circular opening 836 has two spaced apart key portions 838 (individually identified as a first key portion 838*a* and a second key portion 838*b*). The circular opening 836 and associated key portions 838 are configured to be generally aligned with the first opening 813 and corresponding key portions 818 of the first extension portion 612 of the first stock mount plate 611. The second stock mount plate 630 also includes leg support portions 832 (individually identified as a first leg support portion 832*a* and a second leg support portion 832*b*). Each leg support portion 832 includes leg attachment openings 835 (individually identified as a first leg attachment opening 835*a* and a second leg attachment opening 835*b*) and a stop portion 834 (individually identified as a first stop portion 834*a* and a second stop portion 834*b*). The leg attachment openings 835 are configured to receive a fastener (e.g., rivet, screw, bolt, etc.) to attach the corresponding legs 150, and the stop portions 834 are configured to provide a stop for the legs 150 in a stowed position.

The third stock mount plate 650 includes a generally circular opening 854 that is configured to be aligned with the first opening 813 of the first extension portion 612 of the first stock mount plate 611, as well as the opening 836 of the second stock mount plate 630. The third stock mount 650 plate also includes angled side portions 852 (individually identified as a first angled side portion 852*a* and a second angled side portion 852*b*) with associated attachment apertures 853 (individually identified as a first attachment aperture 853*a* and a second attachment aperture 853*b*) to receive a protruding member (e.g., post, bolt, screw, etc.) for attachment to a spring (FIG. 6A).

Figure 9:
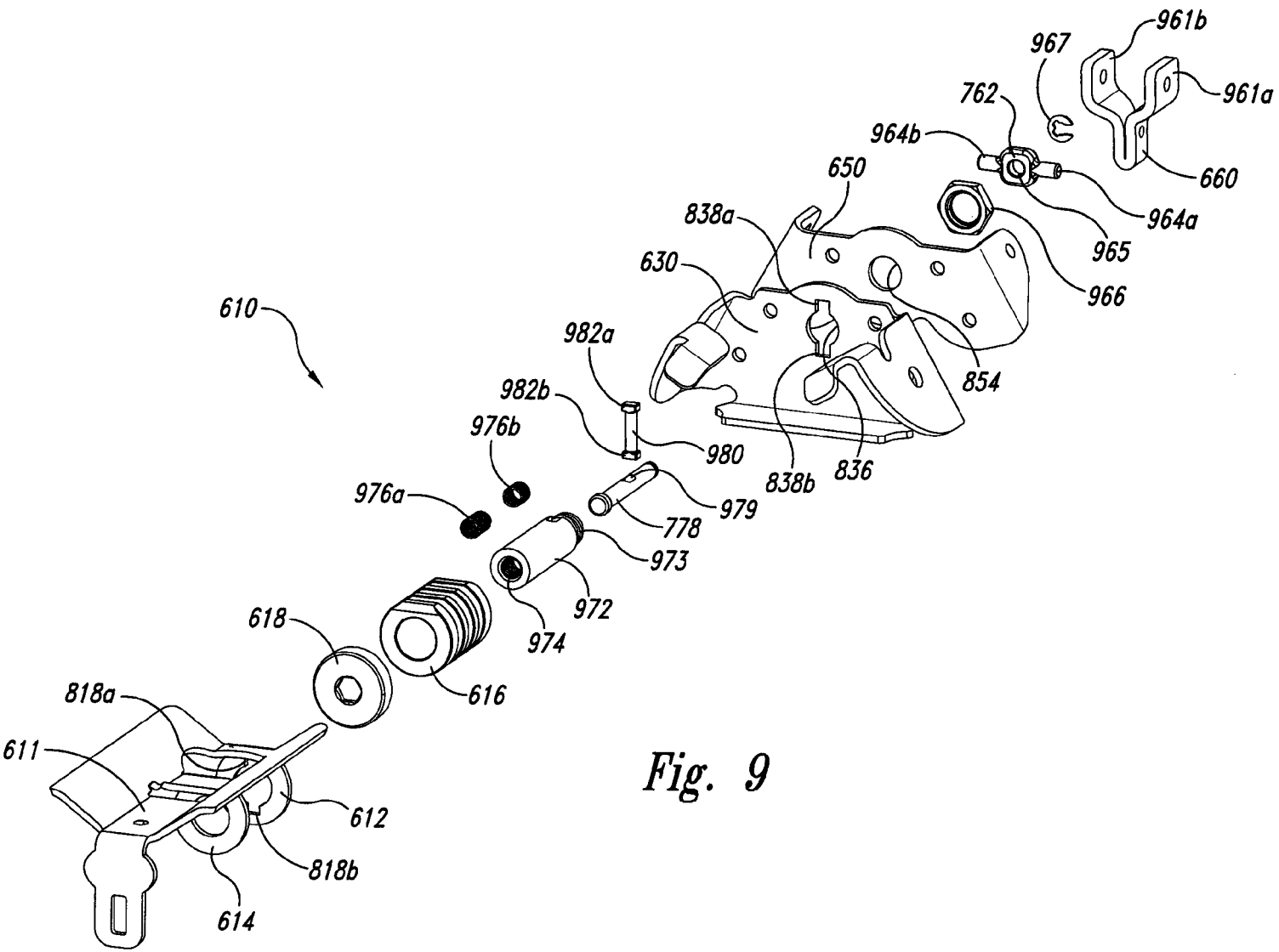

FIG. 9 is an exploded isometric view of the stock mount assembly 610. In the illustrated embodiment, the stock mount assembly 610 includes a tension screw bushing 972 including a first end portion 973 having external threads and a second end portion 974 having internal threads. The tension screw bushing 972 is configured to fit within the cylindrical opening of the swivel bushing 616, and the second end portion 974 is configured to threadably engage a portion of the swivel bushing cap 618 (see, e.g., FIG. 10). The tension screw bushing 972 has a generally hollow and cylindrical body that is configured to receive the tension screw 778 and biasing members 976 (individually identified as a first biasing member 976*a* and a second biasing member 976*b*). The tension screw 778 includes an opening 979 extending therethrough that is configured to receive a lock member 980. The lock member 980 includes spaced apart end portions 982 (individually identified as a first end portion 982*a* and a second end portion 982*b*) that are configured to correspond to the key portions 818 of the first extension portion 612 of the first stock mount plate 611, as well as to the key portions 838 of the circular opening 836 of the second stock mount plate 630.

The stock mount assembly 610 also includes a bushing nut 966 that is configured to threadably engage the first end portion 973 of the tension screw bushing 972. The cam bushing 762 includes an opening 965 that is configured to receive an end portion of the tension screw 778, and a clip member 967 retains the cam bushing 762 on the end portion of the tension screw 778. The cam busing 762 includes two arm members 964 (individually identified as a first arm member 964*a* and a second arm member 964*b*) extending generally laterally from the opening 965. The cam lever 660 has a generally Y-shaped configuration including two cam lever arms 961 (individually identified as a first cam lever arm 961*a* and a second cam lever arm 961*b*). The cam lever arms 961 engage the corresponding arms 964 of the cam bushing 762. As described in detail below, that the cam lever 660 pulls the cam bushing 762 and the attached tension screw 778 and corresponding lock member 980 to lock or unlock the rotation of the stock mount assembly 610.

Figure 10:
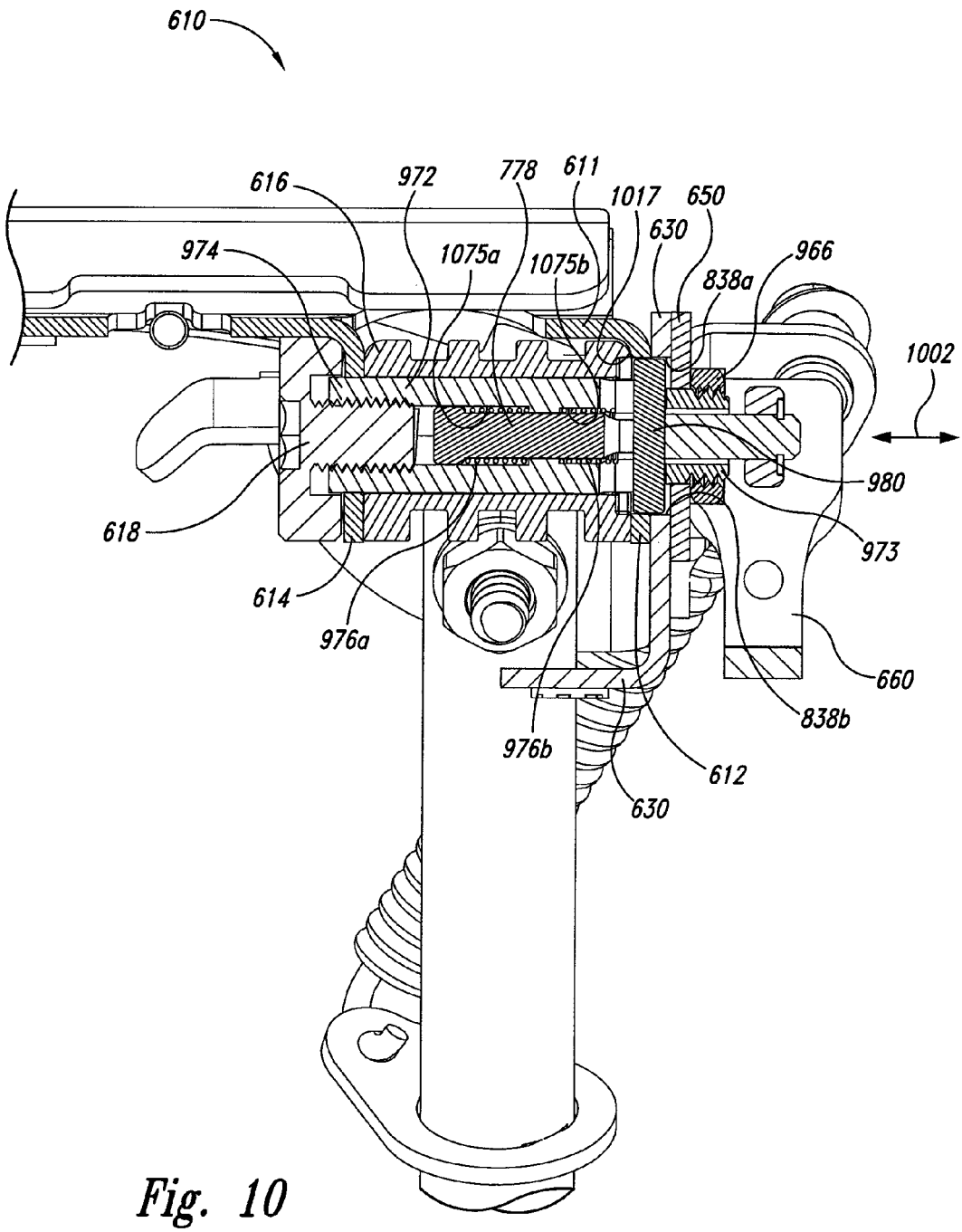
FIG. 10 is a cross-sectional view of the stock mount assembly configured in accordance with an embodiment of the disclosure.

FIG. 10 is a cross-sectional view of the assembled stock mount assembly 610. In the illustrated embodiment the tension screw 778 extends through each of the first stock mount plate 611, the second stock mount plate 630, and the third stock mount plate 650. The tension screw bushing 972 is positioned inside the swivel bushing 616, and the first end portion 973 of the tension screw 778 is threadably engaged with the bushing nut 966, and the second end portion 974 of the tension screw 778 is threadably engaged with the swivel bushing cap 618. The tension screw bushing 972 includes a first cavity 1075*a* and a second cavity 1075*b*. The first cavity 1075*a* encompasses the first biasing member 976*a* surrounding the tension screw 778, and the second cavity encompasses the second biasing member 976*b* also surrounding the tension screw 778.

In the illustrated embodiment, the tension screw 778 is movable in the directions of the double headed arrow 1002 to unlock or lock the rotation of the stock mount assembly 610. More specifically, as the lock member 980 is moved by the tension screw 778, the lock member 980 remains at least partially engaged with the key portions 818 of the first extension portion 612 of the first stock mount plate 611. In this manner, the rotation of the first stock mount plate 611 is tied to the rotation of the lock member 980.

In the position illustrated in FIG. 10, the cam lever 660 is extending downward and generally adjacent to the third stock mount plate 650. In this position the lock member 980 is at least partially pulled into the key portions 838 of the circular opening 836 of the second stock mount plate 630 to lock the rotation of the stock mount assembly 610. When the cam lever 660 is pivoted to extend away from the third stock mount plate 650, the tension screw 778 moves the lock member 980 toward the swivel bushing 616. As the lock member 980 moves in this direction, the lock member 980 disengages from the second stock mount plate 630 and is at least partially received in a corresponding cavity 1017 in the swivel bushing 616. When the lock member 980 is moved from the second stock mount plate 630, the first stock mount plate 611 is free to rotate or swivel about the tension screw 778 captured in the tension screw bushing 972 and the swivel bushing 616. In this manner, the stock mount assembly 610 provides for adjustable rotational positioning of a firearm attached to the support 600.

From the foregoing, it will be appreciated that specific embodiments of the disclosure have been described herein for purposes of illustration, but that various modifications may be made without deviating from the spirit and scope of the various embodiments of the disclosure. For example, the firearm supports can include configurations other than those illustrated in the Figures. Further, while various advantages and features associated with certain embodiments of the disclosure have been described above in the context of those embodiments, other embodiments may also exhibit such advantages or features, and not all embodiments need necessarily exhibit such advantages and/or features to fall within the scope of the disclosure. Accordingly, the disclosure is not limited, except as by the appended claims.

We claim:

1. A bipod assembly for use with a firearm, the bipod assembly comprising:

a stock mount assembly configured to support a forestock of the firearm, wherein the stock mount assembly includes a nonferrous metal or alloy first stock mount plate, a second stock mount plate and a lock member, wherein the lock member is moveable from a first position and a second position, wherein in the first position the lock member engages the first stock mount plate and the first stock mount plate is rotatable with reference to the second stock mount plate, and wherein in the second position the lock member engages the first stock mount plate and the second stock mount plate to lock the first stock mount plate with reference to the second stock mount plate;

an attachment assembly carried by the stock mount assembly and configured to releasably attach to the forestock of the firearm; and first and second legs operably coupled to the first stock mount plate, wherein at least a portion of each leg is nonferrous metal or alloy, and wherein each leg is pivotable between a stowed position and an extended position, wherein in the stowed position the legs are generally parallel to a longitudinal axis of the firearm and in the extended position the legs are generally transverse to the longitudinal axis of the firearm.

2. The bipod assembly of claim 1 wherein each leg includes an upper portion having a body configured to slidably receive a lower portion of the leg inside the body, wherein the body is a tubular titanium member formed with a welded seam extending axially along the body at an exterior surface of the body.

3. A bipod assembly for use with a firearm, the bipod assembly comprising:

a stock mount assembly configured to support a forestock of the firearm, wherein the stock mount assembly includes a nonferrous metal or alloy support plate;

an attachment assembly carried by the stock mount assembly and configured to releasably attach to the forestock of the firearm; and first and second legs operably coupled to the support plate, wherein each leg includes an upper portion having a body configured to slidably receive a lower portion of the leg, wherein the body includes a groove having an inner diameter and the lower portion includes a slot for receiving a retention member, wherein the retention member has an outer diameter that is greater than the inner diameter of the groove, wherein at least a portion of each leg is nonferrous metal or alloy, and wherein each leg is pivotable between a stowed position and an extended position, wherein in the stowed position the legs are generally parallel to a longitudinal axis of the firearm and in the extended position the legs are generally transverse to the longitudinal axis of the firearm.

4. The bipod assembly of claim 3 wherein the attachment assembly includes two side arms operably coupled to the support plate, and two tension arms operably coupled to the side arms.

5. The bipod assembly of claim 4 wherein the attachment assembly further includes a locknut retained between the two side arms, and wherein the locknut threadably engages a tension member extending therethrough.

6. The bipod assembly of claim 3 wherein the support plate includes a mounting portion extending generally transverse from the support plate, wherein the mounting portion has a generally planar surface configured to receive a label including reference indicia associated with the bipod assembly.

7. The bipod assembly of claim 3 wherein the support plate includes leg support portions extending from the support plate, and wherein the stock mount assembly further includes a brace member attached to each of the leg support portions and spaced apart from the support plate, wherein the brace member has a generally planar surface configured to receive a label including reference indicia associated with the bipod assembly.

8. A bipod assembly for use with a firearm, the bipod assembly comprising:

a stock mount assembly configured to support a forestock of the firearm, wherein the stock mount assembly includes— a first plate operably coupled to a second plate;

a cam lever configured to move a tension screw through the first and second plates in a direction generally parallel to a longitudinal axis of the firearm, wherein the tension screw is movable between a first position that locks the first plate with reference to the second plate, and a second position that allows the first plate to rotate with reference to the second plate; and a swivel bushing carried by the first plate and a tension screw bushing carried in the swivel bushing, wherein the tension screw is axially movable in the tension screw bushing between the first and second positions;

an attachment assembly carried by the stock mount assembly and configured to releasably attach to the forestock; and first and second legs extending from the stock mount assembly;

wherein at least one of the stock mount assembly, attachment assembly, and/or the first and second legs comprise a nonferrous material.

9. The bipod assembly of claim 8 wherein the stock mount assembly further includes a lock member carried by the tension screw, wherein the lock member is engaged with the first plate in the first position, and wherein the lock member is disengaged with the first plate and engaged with the second plate in the second position.

10. The bipod assembly of claim 8 wherein the cam lever is pivotable to move the tension screw in a longitudinal direction between the first and second positions.

11. A bipod assembly for use with a firearm, the bipod assembly comprising:

a stock mount assembly configured to support a forestock of the firearm, wherein the stock mount assembly includes— a first plate operably coupled to a second plate; and a cam lever configured to move a tension screw through the first and second plates in a direction generally parallel to a longitudinal axis of the firearm, wherein the tension screw is movable between a first position that locks the first plate with reference to the second plate, and a second position that allows the first plate to rotate with reference to the second plate, wherein the cam lever is operably coupled to an end portion of the tension screw, and wherein pivoting the cam lever from a first pivot position to a second pivot position decreases a distance from the end portion of the tension screw to the second plate;

an attachment assembly carried by the stock mount assembly and configured to releasably attach to the forestock; and first and second legs extending from the stock mount assembly;

wherein at least one of the stock mount assembly, attachment assembly, and/or the first and second legs comprise a nonferrous material.

12. The bipod assembly of claim 8 wherein the first plate, the second plate, at least a portion of the attachment assembly, and at least a portion of each of the legs are made from titanium.

13. The bipod assembly of claim 8 wherein each of the legs comprises:

a lower portion that is extendable from an upper portion; and a locking assembly having a die-cast housing to retain the lower portion in one of a plurality of incremental positions extending from the upper portion.

14. The bipod assembly of claim 8 wherein each of the legs includes an upper leg portion having a body configured to slidably receive a lower leg portion, wherein the body includes a groove that is configured to contact retention members carried by the lower leg portion to at least partially retain the lower leg portion in the body.

15. A bipod assembly for use with a firearm, the bipod assembly comprising:

a stock mount assembly including a first plate operably coupled to a second plate, and first means for rotationally locking the first plate with reference to the second plate;

an attachment assembly configured to attach to the forestock of the firearm, wherein the attachment assembly is carried by the stock mount assembly and includes second means for adjusting a tension of the attachment of the forestock, wherein the second means includes:

a pair of side arms operably coupled to the first plate;

a locknut carried by the side arms;

a pair of tension arms extending from the side arms through an opening in the first plate to attach to the forestock; and a threaded shaft threadably engaged with the locknut, wherein the threaded shaft is configured to contact the first plate to increase the tension of the tension arms; and a pair of legs operably coupled to the first means, wherein each leg includes third means for adjusting a length of the leg;

wherein at least one of the first means, second means, and/or third means comprises a nonferrous material.

16. The bipod assembly of claim 15 wherein the first means includes a cam lever that is pivotable to move a tension screw carrying a lock member between a locked position and a rotatable position, wherein in the locked position the lock member engages the first plate and the second plate, and in the second position the lock member disengages the second plate and engages the first plate.

17. A bipod assembly for use with a firearm, the bipod assembly comprising:

a stock mount assembly including a first plate operably coupled to a second plate, and first means for rotationally locking the first plate with reference to the second plate;

an attachment assembly configured to attach to the forestock of the firearm, wherein the attachment assembly is carried by the stock mount assembly and includes second means for adjusting a tension of the attachment of the forestock; and a pair of legs operably coupled to the first means, wherein each leg includes third means for adjusting a length of the leg, wherein each leg includes an upper leg portion and a lower leg portion, and wherein the third means includes:

a plunger housing carried on an end portion of the upper leg portion;

a spring-loaded plunger carried by the plunger housing; and a retaining ring carried by the plunger housing, wherein the retaining ring includes a flange operably coupled to the plunger and a tab configured to be inserted into a corresponding slot in the upper leg portion, and wherein the retainer ring is movable from a first position in which the tab is removed from the slot and a second position in which the tab is inserted into the slot to engage the lower leg portion;

wherein at least one of the first means, second means, and/or third means comprises a nonferrous material.

* * * * *